US012054896B2

(12) United States Patent
Von Handorf et al.

(10) Patent No.: US 12,054,896 B2
(45) Date of Patent: Aug. 6, 2024

(54) SYSTEM FOR AN ARCH BRIDGE AND METHODS OF PRODUCING THE SAME

(71) Applicant: Structure Sight LLC, Dayton, OH (US)

(72) Inventors: Jeffrey J. Von Handorf, Waynesville, OH (US); Tommy E. Nicholson, Bellbrook, OH (US)

(73) Assignee: Structure Sight LLC, Dayton, OH (US)

( * ) Notice: Subject to any disclaimer, the term of this patent is extended or adjusted under 35 U.S.C. 154(b) by 538 days.

(21) Appl. No.: 17/445,531

(22) Filed: Aug. 20, 2021

(65) Prior Publication Data

US 2023/0057146 A1 Feb. 23, 2023

(51) Int. Cl.

| | |
|---|---|
| ***E01D 4/00*** | (2006.01) |
| ***E01D 19/02*** | (2006.01) |
| ***E01D 21/00*** | (2006.01) |
| *E01D 101/26* | (2006.01) |

(52) U.S. Cl.

CPC ..... *E01D 4/00* (2013.01); *E01D 19/02* (2013.01); *E01D 21/00* (2013.01); *E01D 2101/262* (2013.01); *E01D 2101/264* (2013.01); *E01D 2101/268* (2013.01)

(58) Field of Classification Search

CPC ..... E01D 4/00; E01D 19/02; E01D 21/00; E01D 2101/262; E01D 2101/264; E01D 2101/268

USPC ..... 14/24, 26

See application file for complete search history.

(56) References Cited

U.S. PATENT DOCUMENTS

| | | | | |
|---|---|---|---|---|
| 590,490 | A * | 9/1897 | Thomas et al. | E01D 4/00 14/24 |
| 786,059 | A | 3/1905 | Simpson | |
| 3,768,108 | A * | 10/1973 | Wadsworth | E01D 15/133 14/24 |
| 4,587,684 | A * | 5/1986 | Miller | E01D 4/00 14/15 |
| 5,836,717 | A | 11/1998 | Bernini | |
| 6,408,581 | B2 * | 6/2002 | Monachino | E02D 27/02 52/297 |

(Continued)

FOREIGN PATENT DOCUMENTS

| | | | |
|---|---|---|---|
| KR | 100789990 | B1 | 1/2008 |
| KR | 101099885 | B1 | 12/2011 |

(Continued)

*Primary Examiner* — Raymond W Addie
(74) *Attorney, Agent, or Firm* — Stevens & Showalter LLP

(57) ABSTRACT

An arch bridge system including first and second side walls, a foundation, and arch beams. The first and second side walls each include side wall sections supported by the foundation and aligned along the width of the system. Adjacent side wall sections form a column therebetween that defines an interior void extending along a height of the column. A first end of each arch beam is supported at the first side wall at an upper portion of one of the columns and a second end is supported at the second side wall at an upper portion of another one of the columns. Each interior void has reinforced concrete forming cast-in-place columns defining rigid, fixed, monolithic connections between the foundation, the first and second side walls, and the plurality of arch beams. A method of producing an arch bridge system is also disclosed.

20 Claims, 13 Drawing Sheets

(56) References Cited

U.S. PATENT DOCUMENTS

| | | | | |
|---|---|---|---|---|
| 6,434,892 | B1 | 8/2002 | Heierli | |
| 6,988,337 | B1 | 1/2006 | Heierli | |
| 7,204,058 | B2 * | 4/2007 | Long | E01D 22/00 52/89 |
| 7,305,798 | B1 | 12/2007 | Heierli | |
| 8,789,337 | B2 * | 7/2014 | Aston | E02D 29/045 52/742.13 |
| 10,011,962 | B2 * | 7/2018 | Bennett | E01D 22/00 |
| 11,536,017 | B2 * | 12/2022 | VanHoose | E03F 5/10 |

FOREIGN PATENT DOCUMENTS

| | | | |
|---|---|---|---|
| KR | 101196343 | B1 | 10/2012 |
| KR | 101394975 | B1 | 5/2014 |
| WO | 2006081214 | A2 | 8/2006 |

* cited by examiner

SYSTEM FOR AN ARCH BRIDGE AND METHODS OF PRODUCING THE SAME

TECHNICAL FIELD

The invention is directed to precast structures, and more particularly to an improved system for an arch bridge.

BACKGROUND

Arch bridge systems of a variety of forms and corresponding methods of construction are known in the art and may include bridges, which permit vehicular travel and pedestrian movement above the arch bridge, as well as tunnel systems, which permit travel beneath the arch by, for example, vehicles, pedestrians, watercraft, etc. Often times soil backfill will be placed on top of the arch bridge system to tie in the structure with the surrounding environment.

Many conventional arch bridge systems involve large components that require heavy equipment, including but not limited to large cranes, in order to assemble the structure. Such systems often require forms to be built in the field to produce cast-in-place components. The use of forms requires additional materials, labor, and planning during the production of the arch bridge systems, thus increasing the cost and time needed for construction. Conventional systems often preclude the use of, or make very limited use of, precast and/or modular components and require decking panels with precise joints, which increases the difficulty of matching the shape and alignment of adjacent panels and introduces challenges with design, production, and scalability. Thus, there remains a need for an arch bridge system that permits fast and economical methods of construction that results in a strong and reliable structure.

SUMMARY

In accordance with an aspect of the present disclosure, an arch bridge system is disclosed, the arch bridge system comprising: a first side wall and a second side wall, the first and second side walls extending along a width of the system and being spaced apart with respect to each other to define a length of the system therebetween; a foundation positioned beneath the first and second side walls; and a plurality of arch beams spanning the length of the system and spaced along the width of the system. The first and second side walls may each comprise a plurality of side wall sections supported by the foundation and aligned along the width of the system. Adjacent side wall sections may form a column therebetween, in which the column defines an interior void extending along a height of the column. Each of the plurality of arch beams may comprise a first end and a second end opposite the first end, the first end being supported at the first side wall at an upper portion of one of the columns and the second end being supported at the second side wall at an upper portion of another one of the columns. Each interior void may comprise reinforced concrete forming cast-in-place columns defining rigid, fixed, monolithic connections between the foundation, the first and second side walls, and the plurality of arch beams.

The arch bridge system may further comprise a plurality of decking panel assemblies, in which each decking panel assembly may comprise a plurality of decking panels. Each decking panel may have a first decking panel end and a second decking panel end, in which the first decking panel end is supported by one of the plurality of arch beams and the second decking panel end is supported by an adjacent one of the plurality of arch beams.

Each decking panel assembly may further comprise at least one cable connecting the plurality of decking panels and extending along the length of the system.

The first and second side walls may terminate at a first end wall and a second end wall of the system, in which one of the plurality of arch beams most proximate to the first end wall and one of the plurality of arch beams most proximate to the second end wall each support a headwall.

Each side wall section may comprise a wall panel and an abutment panel, the wall panel being supported by the foundation and the abutment panel being supported by the wall panel. Each abutment panel may comprise a top edge, a bottom edge opposite the top edge, a first support surface, and a pair of second support surfaces, in which the top edge, the first support surface, and the second support surfaces may face away from the foundation, the first support surface may be closer to the foundation than the top edge, and the second support surfaces may be closer to the foundation than the first support surface.

The first end of each of the plurality of arch beams may be supported by ones of the pair of second support surfaces of adjacent abutment panels of the first side wall and the second end of each of the plurality of arch beams may be supported by ones of the pair of second support surfaces of adjacent abutment panels of the second side wall.

Each of the plurality of decking panel assemblies may comprise a first decking panel and a last decking panel, in which the first decking panel may further be supported by the first support surface of one of the abutment panels of the first side wall and the last decking panel may further be supported by the first support surface of one of the abutment panels of the second side wall.

The wall panel and the abutment panel may each comprise an interior side and an exterior side, the interior side being substantially planar and the exterior side defining a respective central cavity.

The reinforced concrete may permanently confine each of the plurality of decking panel assemblies.

The foundation may comprise: (i) strip footings or spread footings; (ii) a slab foundation or mat foundation; or (iii) a deep foundation system comprising driven piles or drilled shafts.

In accordance with another aspect of the present disclosure, a method of producing an arch bridge system is disclosed, the method comprising: installing a foundation; installing a first side wall and a second side wall, the first and second side walls extending a width of the system and being spaced apart with respect to each other to define a length of the system therebetween, the first and second side walls each comprising a plurality of side wall sections supported by the foundation and aligned along the width of the system, in which adjacent side wall sections form a column therebetween, the column comprising an interior void extending along a height of the column; installing a plurality of arch beams that span the length of the system and are spaced along the width of the system, the plurality of arch beams each comprising a first end and a second end opposite the first end, the first end being supported at the first side wall at an upper portion of one of the columns and the second end being supported at the second side wall at an upper portion of another one of the columns; and filling each interior void with concrete to form cast-in-place columns defining rigid, fixed, monolithic connections between the foundation, the first and second side walls, and the plurality of arch beams.

The method may further comprise installing a plurality of decking panel assemblies, in which each decking panel assembly may comprise a plurality of decking panels and each decking panel may have a first decking panel end and a second decking panel end. The first decking panel end may be supported by one of the plurality of arch beams and the second decking panel end may be supported by an adjacent one of the plurality of arch beams.

The plurality of decking panels of each decking panel assembly may be connected with at least one cable extending along the length of the system.

The first and second side walls may terminate at a first end wall and a second end wall of the system, and the method may further comprise installing a headwall at each of (i) one of the plurality of arch beams most proximate to the first end wall and (ii) one of the plurality of arch beams most proximate to the second end wall.

Installing the first and second side walls sections may comprise installing, for each side wall section, a wall panel that is supported by the foundation and an abutment panel supported by the wall panel. Each abutment panel may comprise a top edge, a bottom edge opposite the top edge, a first support surface, and a pair of second support surfaces, in which the top edge, the first support surface, and the second support surfaces may face away from the foundation, the first support surface may be closer to the foundation than the top edge, and the second support surfaces may be closer to the foundation than the first support surface.

The first end of each of the plurality of arch beams may be supported by ones of the pair of second support surfaces of adjacent abutment panels of the first side wall and the second end of each of the plurality of arch beams may be supported by ones of the pair of second support surfaces of adjacent abutment panels of the second side wall.

The wall panel may comprise an interior side and an exterior side, the interior side being substantially planar and the exterior side defining a central cavity.

Each of the plurality of decking panel assemblies may comprise a first decking panel and a last decking panel, in which the first decking panel may further be supported by the first support surface of one of the abutment panels of the first side wall and the last decking panel may further be supported by the first support surface of one of the abutment panels of the second side wall.

The method may further comprise permanently confining each of the plurality of decking panel assemblies with the concrete of the cast-in-place columns.

The foundation may comprise: (i) strip footings or spread footings; (ii) a slab foundation or mat foundation; or (iii) a deep foundation system comprising driven piles or drilled shafts.

BRIEF DESCRIPTION OF THE SEVERAL VIEWS OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION

The following text sets forth a broad description of numerous different embodiments of the present disclosure. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. It should be understood that multiple combinations of the embodiments described and shown are contemplated and that a particular focus on one embodiment does not preclude its inclusion in a combination of other described embodiments. Numerous alternative embodiments could also be implemented, using either current technology or technology developed after the filing date of this patent, which would still fall within the scope of the claims. Finally, when features of the invention are described "in general," it is to be understood that those of ordinary skill in the art will understand that minor deviations are possible without going beyond the scope of the invention.

Figure 1:
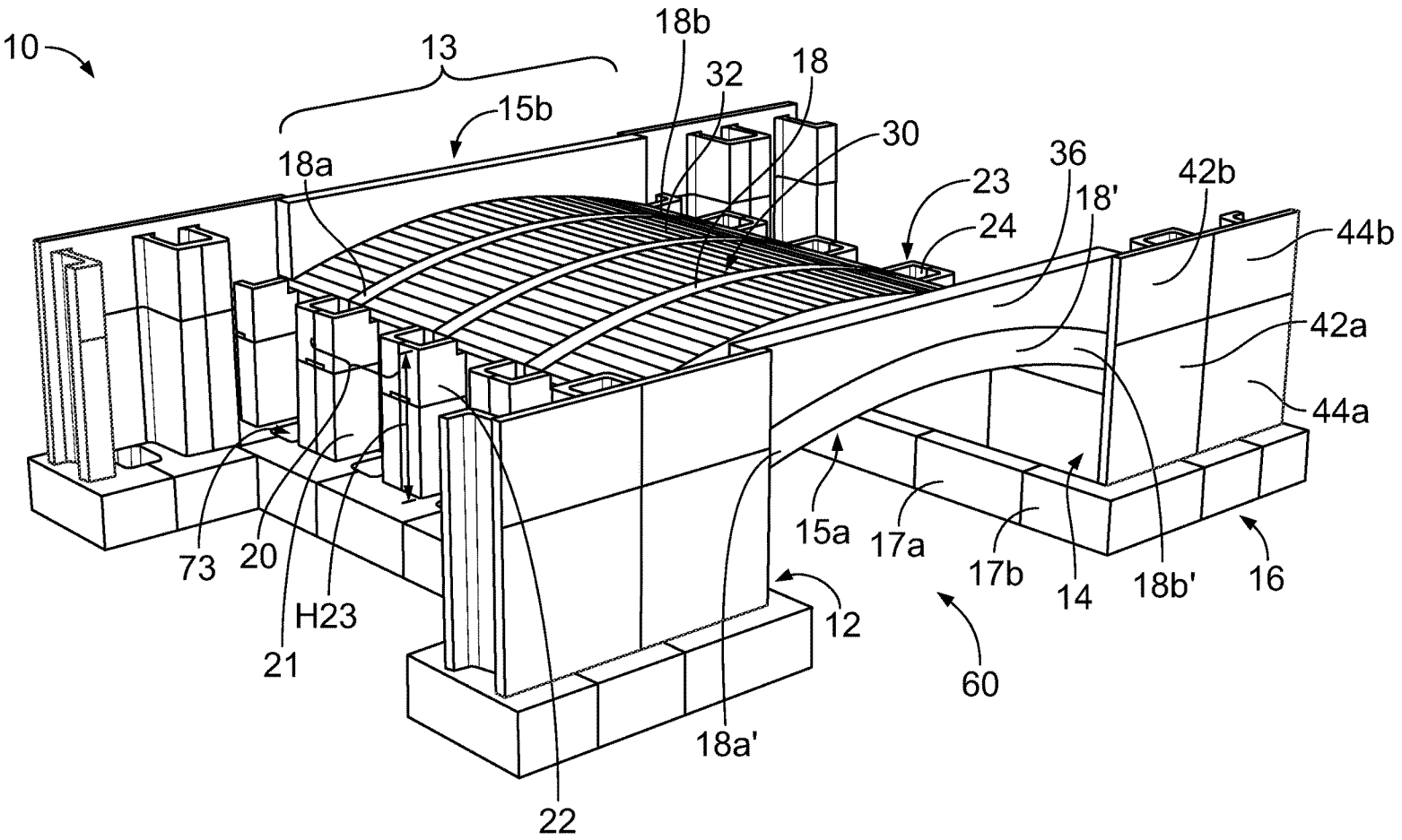
FIGS. 1 and 2 are perspective and top views, respectively, of an arch bridge system according to the present disclosure.
Figure 2:
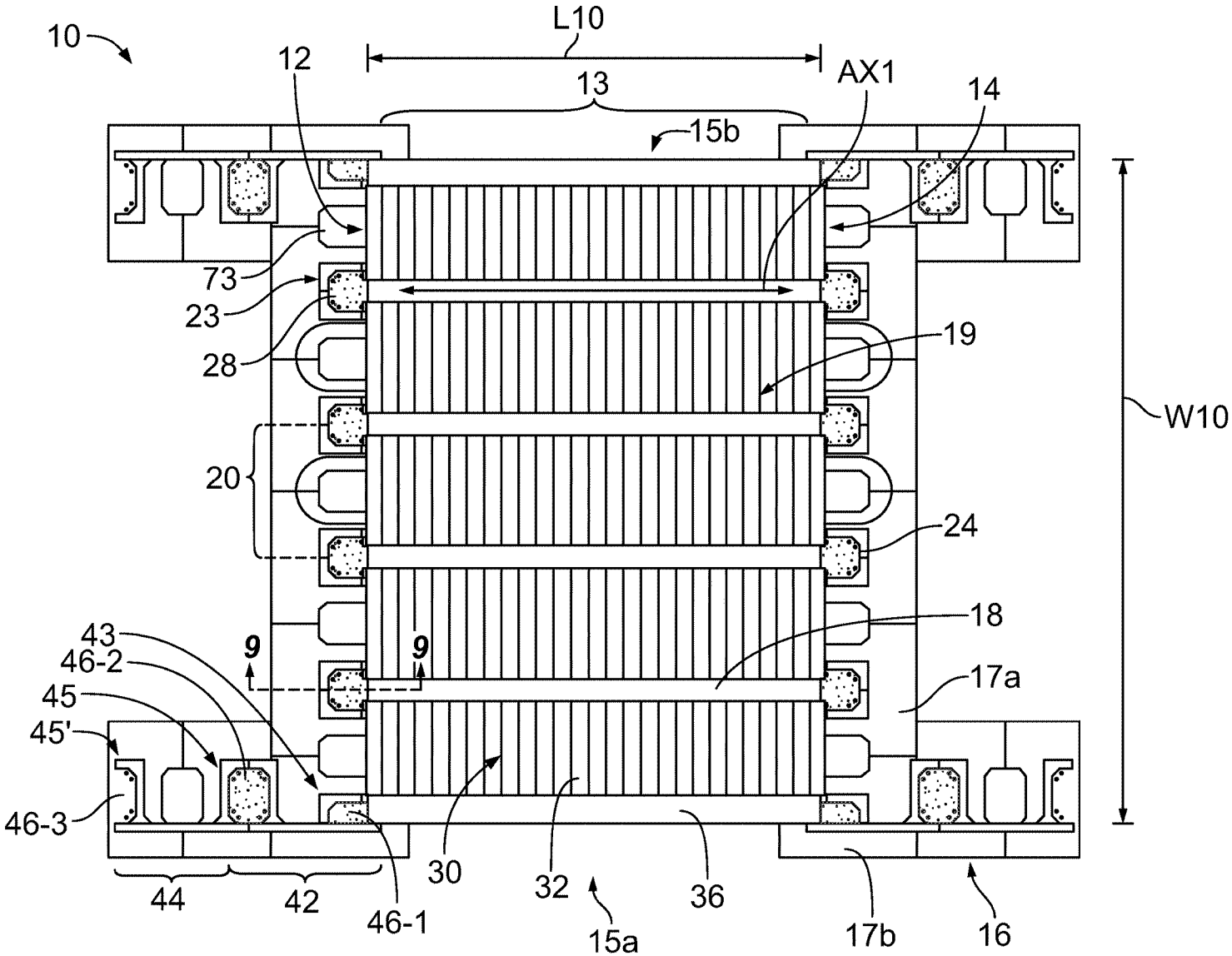

An arch bridge system and corresponding methods of production will be described. Referring to FIGS. 1-2, an arch bridge system or assembly 10 is shown. In general, the arch bridge system 10 may comprise an arch span 13, which may also be referred to simply as an arch, extending between a first retaining wall or side wall 12 and a second retaining or side wall 14, in which the arch 13 and the first and second side walls 12, 14 may define an opening or tunnel 60 beneath the arch 13 and between the first and second side walls 12, 14. As shown in FIG. 2, the first and second side walls 12, 14 may extend along a width W10 of the arch bridge system 10 and may be spaced apart with respect to each other to define a length L10 of the arch bridge system 10 therebetween. A roadway or footpath (not shown) may be located above or below the arch bridge system 10. In some examples, the arch bridge system 10 may be constructed entirely of precast components with the exception of cast-in-place concrete closures, as discussed in more detail below. In other examples, the arch bridge system 10 may comprise a combination of one or more precast components and one or more conventional, cast-in-place components.

The arch bridge system 10 may comprise a foundation 16 that is positioned beneath and supports the side walls 12, 14.

The foundation 16 may comprise one or more precast modular foundation pieces 17*a*, 17*b*. The foundation pieces 17*a*, 17*b* may be installed directly on a crushed stone bedding or leveling layer. Correct installation of the foundation pieces 17*a*, 17*b* may ensure fit-up of the entire arch bridge system 10. In some examples, the foundation 16 may take the form of strip footings or spread footings or a slab foundation or a mat foundation bearing directly on soil or bedrock. In other examples, the foundation 16 may be supported by a deep foundation system such as driven piles, drilled shafts, or other methods.

Figure 3A:
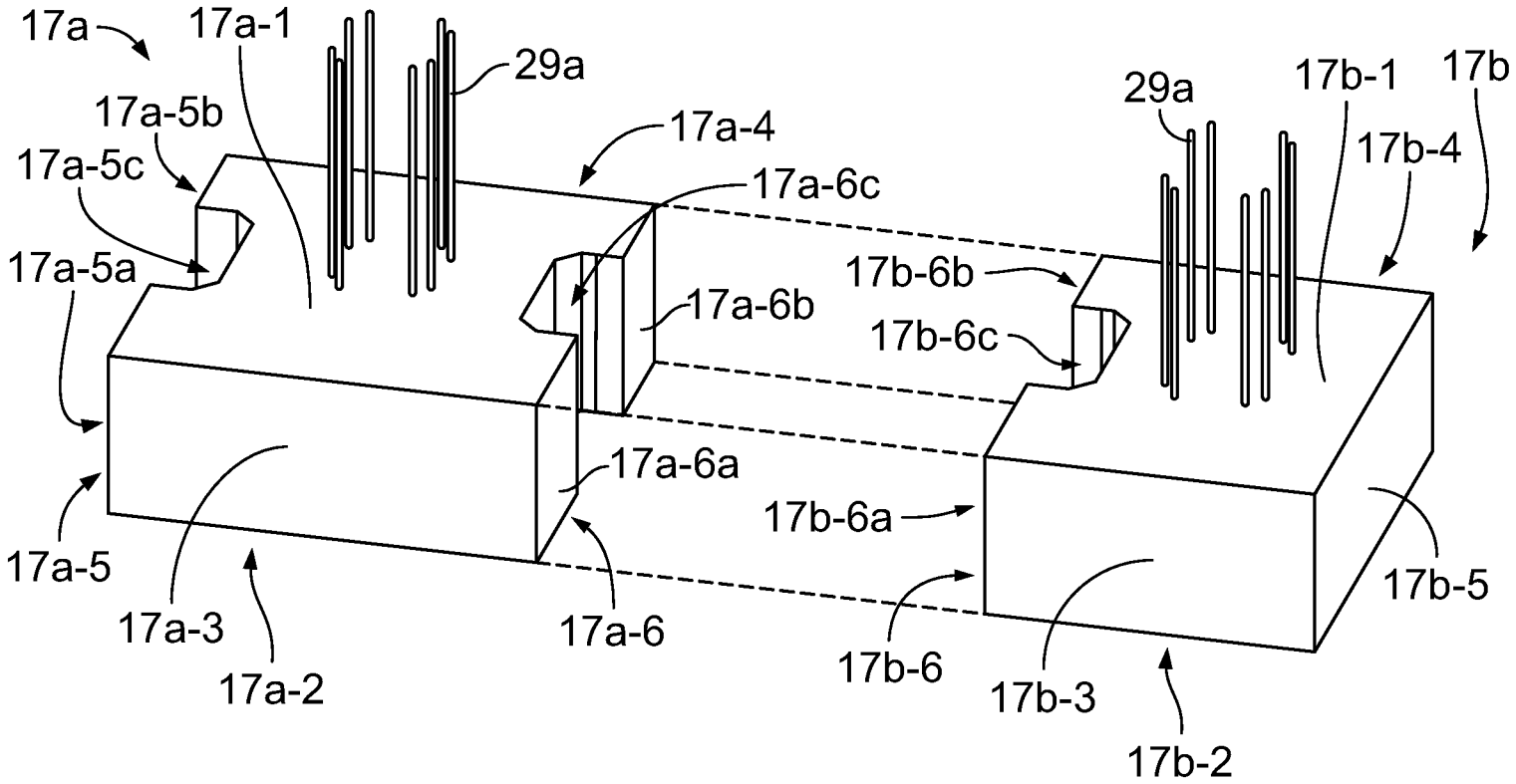
FIGS. 3A-4D are illustrations of individual precast components of the arch bridge system of FIG. 1.

As shown in FIGS. 1, 2, and 3A, the foundation 16 may comprise one or more of foundation pieces 17*a*, 17*b*. In the example shown, the foundation piece 17*a* may generally be located toward a center (not labeled) of the arch bridge system 10 (e.g., interior), and the foundation piece 17*b* may be located along the outer edges of the arch bridge system 10 (e.g., exterior), as described herein in more detail. With reference to FIG. 3A, the foundation piece 17*a* may comprise a top side 17*a*-1, a bottom side 17*a*-2, an interior side 17*a*-3, an exterior side 17*a*-4, a first side 17*a*-5, and a second side 17*a*-6. The interior side 17*a*-3 of the foundation piece 17*a* may face toward the center of the arch bridge system 10, and the exterior side 17*a*-4 may face away from the center of the arch bridge system 10 (see FIG. 2). The first side 17*a*-5 may comprise an interior side panel 17*a*-5*a* and an exterior side panel 17*a*-5*b* separated by a side channel 17*a*-5*c* that extends from the top side 17*a*-1 to the bottom side 17*a*-2. The interior side panel 17*a*-5*a* and the exterior side panel 17*a*-5*b* may be substantially coplanar. The second side 17*a*-6 may comprise an interior side panel 17*a*-6*a* and an exterior side panel 17*a*-6*b* separated by a side channel 17*a*-6*c* that extends from the top side 17*a*-1 to the bottom side 17*a*-2. The interior side panel 17*a*-6*a* and the exterior side panel 17*a*-6*b* may be substantially coplanar, such that the foundation piece 17*a* may be shaped similar to a capital "I."

With continued reference to FIG. 3A, the foundation piece 17*b* may comprise a top side 17*b*-1, a bottom side 17*b*-2, a first side 17*b*-3, a second side 17*b*-4, a third side 17*b*-5, and a fourth side 17*b*-6. The third side 17*b*-5 of the foundation piece 17*b* may be substantially flat, and the fourth side 17*b*-6 may comprise an interior side panel 17*b*-6*a* and an exterior side panel 17*b*-6*b* separated by a side channel 17*b*-6*c* that extends from the top side 17*b*-1 to the bottom side 17*b*-2. The interior side panel 17*b*-6*a* and the exterior side panel 17*b*-6*b* of the foundation piece 17*b* may be substantially coplanar. The foundation piece 17*b* may be shaped similar to a capital "C."

In some examples, the fourth side 17*b*-6 of foundation piece 17*b* may be adjoined with a first or second side 17*a*-5, 17*a*-6 of another foundation piece 17*a*, as shown by the dotted lines in FIG. 3A. The side channel 17*a*-5*c* or 17*a*-6*c* of the foundation piece 17*a* may be aligned with the side channel 17*b*-6*c* of the foundation piece 17*b* to define a cavity 73 between the adjoined foundation pieces 17*a*, 17*b*. In other examples, the first and second side 17*a*-5, 17*a*-6 of the foundation piece 17*a* may be adjoined with a second or first side 17*a*-6, 17*a*-5, respectively, of another adjacent foundation piece 17*a* (see FIGS. 2 and 8A). The respective side channels 17*a*-5*c*, 17*a*-6*c* of the foundation pieces 17*a* may be aligned to define a cavity 73 between the adjoined foundation pieces 17*a*. The cavity 73 formed between adjoined foundation pieces 17*a*, 17*b* can be seen most clearly in FIG. 2. The side channels 17*a*-5*c*, 17*a*-6*c*, 17*b*-6*c* may serve to reduce the weight of the respective foundation pieces 17*a*, 17*b*. The cavity 73 may optionally be filled with concrete to provide further stability to the arch bridge system 10.

Figure 8A:
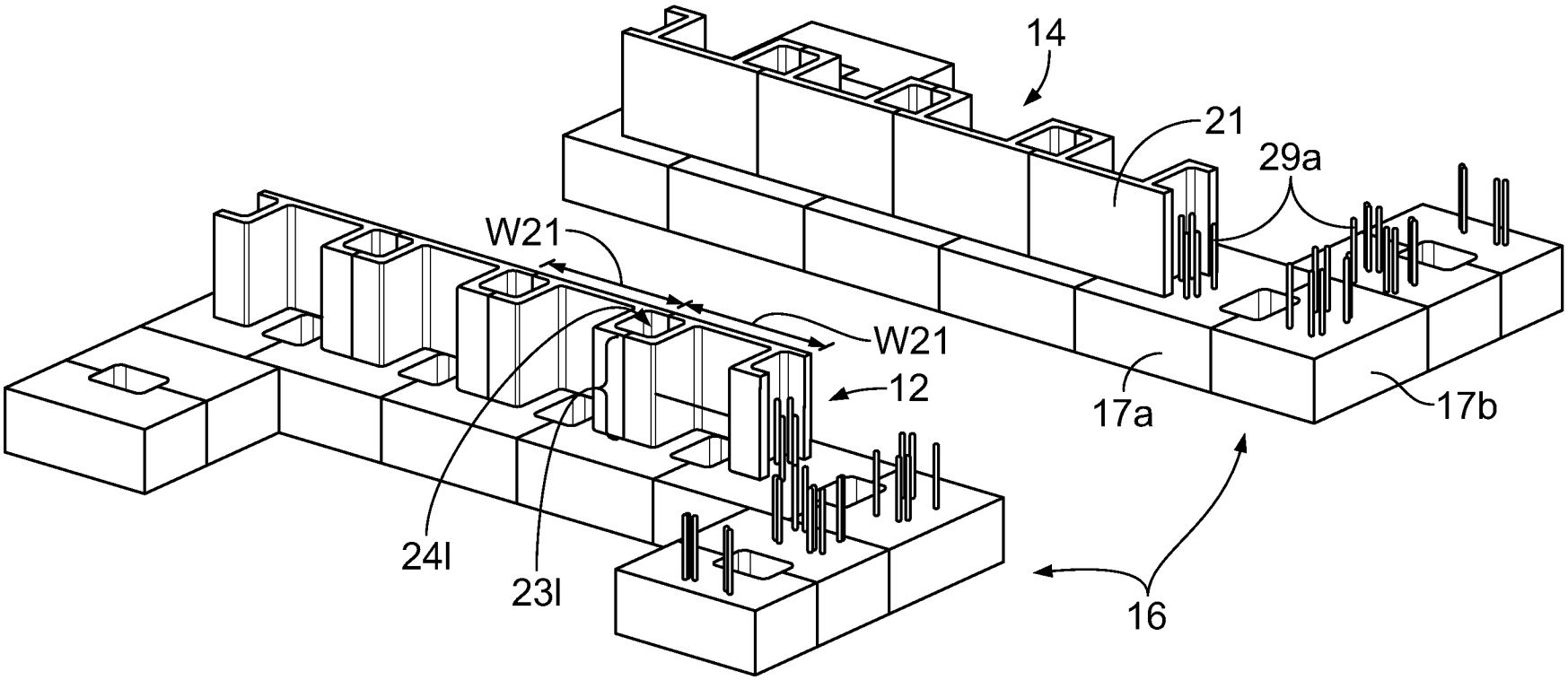
FIGS. 8A-8C are perspective views illustrating various stages during a method for producing an arch bridge system according to the present disclosure.

As shown in FIG. 3A, the foundation pieces 17*a*, 17*b* may have foundation dowels 29*a* extending therefrom in an upwards direction at locations that correspond to where cast-in-place columns 28 of the arch bridge system 10 may be located, as described herein in more detail (see also FIG. 8A). In particular, the foundation dowels 29*a* may extend from the top side 17*a*-1, 17*b*-1 of the respective foundation pieces 17*a*, 17*b*, with the bottom side 17*a*-2, 17*b*-2 being opposite the respective top side 17*a*-1, 17*b*-1. In some examples, the foundation dowels 29*a* may comprise one or more metal reinforcing bars (also referred to herein as rebar) that are embedded within the foundation pieces 17*a*, 17*b* during formation. In other examples, the foundation dowels 29*a* may comprise fiberglass or other type(s) of composite material(s).

With reference to FIGS. 1-2, the first and second side walls 12, 14 may each comprise one or more side wall sections 20 that are supported by the foundation 16 and are aligned along the width W10 of the arch bridge system 10. Each side wall section 20 may be precast and may be modular in nature such that the width W10 can be controlled by a number and/or dimension(s) of the side wall section(s) 20. A column 23 may be formed between adjacent side wall sections 20, as described herein in more detail, in which each column 23 may define an interior void 24 extending vertically along a height H23 of the column 23.

Each side wall section 20 may comprise one or more wall panels 21 and an abutment panel 22. The wall panel(s) 21 may be supported by the foundation 16, and the abutment panel 22 may be positioned at the top of the side wall section 20 and supported by the one or more wall panels 21 stacked thereunder. An exemplary wall panel 21 and abutment panel 22 are shown in FIGS. 3B and 3C, respectively.

Figure 3B:
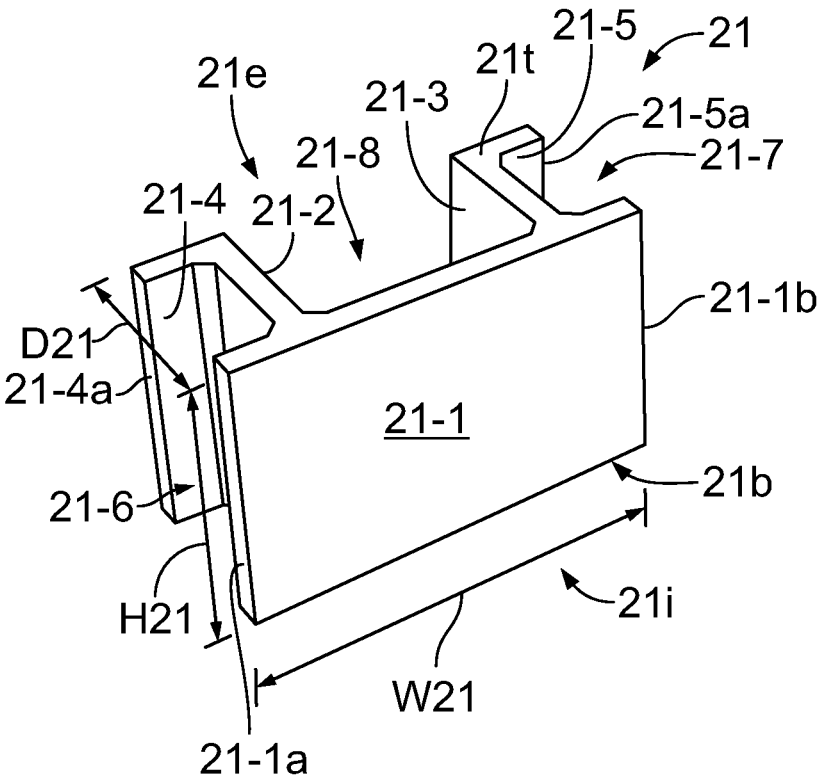
Figure 3C:
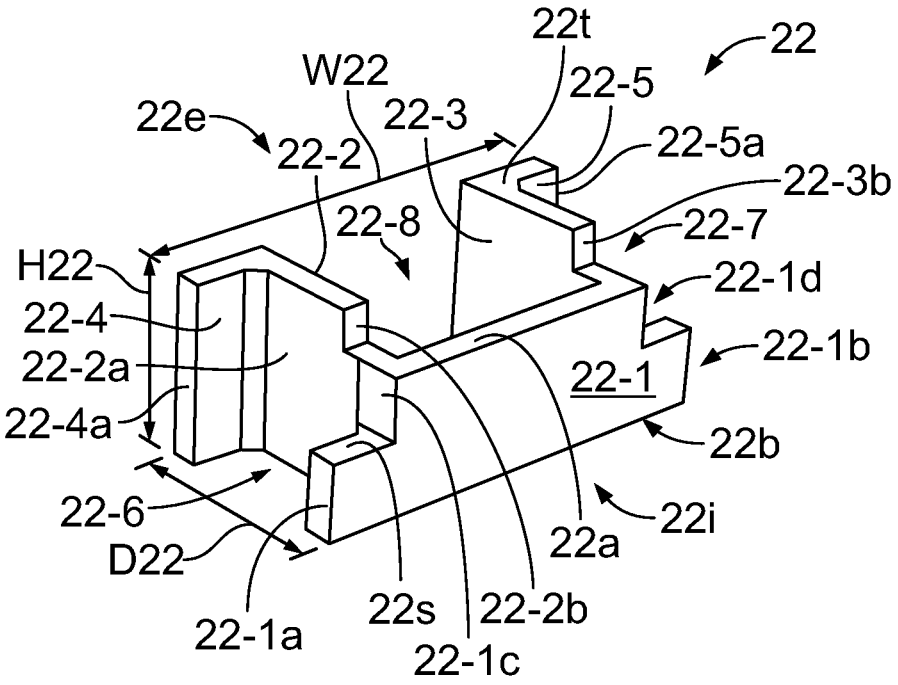

With reference to FIG. 3B, the wall panel 21 may comprise a height H21, a width W21, and a depth D21. The wall panel 21 may comprise an interior side 21*i* and an exterior side 21*e* with respect to the arch bridge system 10, in which the interior side 21*i* faces the opening or tunnel 60 beneath the arch 13 and the exterior side 21*e* faces the opposite direction of the interior side 21*i*. The interior side 21*i* may be substantially flat or planar, but the exterior side 21*e* may define a central cavity 21-8, as described below in more detail.

In one example, the wall panel 21 may comprise an interior panel 21-1 that is substantially planar. The interior panel 21-1 may comprise a first interior side edge 21-1*a* and a second interior side edge 21-1*b*. A first side wall 21-2 of the wall panel 21 and a second side wall 21-3 of the wall panel 21 may be formed on and extend from the interior panel 21-1 in a direction that is substantially perpendicular to the interior panel 21-1. The first and second side walls 21-2, 21-3 may be spaced inward from the first and second interior side edges 21-1*a*, 21-1*b* of the interior panel 21-1, as seen in FIG. 3B. The first side wall 21-2 may comprise a first exterior panel 21-4 that is formed on and extends from the first side wall 21-2 in a direction that is substantially perpendicular to the first side wall 21-2 and substantially parallel to the interior wall panel 21-1. The first exterior panel 21-4 may extend outward and may comprise a first exterior side edge 21-4*a* that is coplanar with the first interior side edge 21-1*a*. The second side wall 21-3 may similarly comprise a second exterior panel 21-5 that is formed on and extends from the second side wall 21-3 in a direction that is substantially perpendicular to the second side wall 21-3 and substantially parallel to the interior wall panel 21-1. The second exterior panel 21-5 may extend outward and may comprise a second exterior side edge 21-5*a* that is coplanar with the second interior side edge 21-1*b*.

With continued reference to FIG. 3B, the wall panel 21 may further comprise a first or top edge 21*t* and a second or bottom edge 21*b* positioned opposite the top edge 21*t*. The top edge 21*t* may be defined by where the interior panel 21-1, the first and second side walls 21-2, 21-3, and the first and second exterior panels 21-4, 21-5 terminate in the upwards direction, i.e., along the direction defined by the height H21 of the wall panel 21. The bottom edge 21*b* may be defined by where the interior panel 21-1, the first and second side walls 21-2, 21-3, and the first and second exterior panels 21-4, 21-5 terminate in the downwards direction, i.e., along the direction defined by the height H21 of the wall panel 21. The top and bottom edges 21*t*, 21*b* of each wall panel 21 may each reside in a single respective plane, i.e., all surfaces defining the top edge 21*t* may be coplanar with each other, and all surfaces defining the bottom edge 21*b* may be coplanar with each other. The plane in which the top edge 21*t* resides may be parallel to the plane in which the bottom edge 21*b* resides.

A first side cavity 21-6 may be defined by the interior panel 21-1, the first side wall 21-2, and the first exterior panel 21-4. A second side cavity 21-7 may be defined by the interior panel 21-1, the second side wall 21-3, and the second exterior panel 21-5. The central cavity 21-8 may be defined by the interior panel 21-1 and the first and second side walls 21-2, 21-3. With reference to FIGS. 3B and 8A, when one wall panel 21 is adjoined with another wall panel 21, the first side cavity 21-6 of one wall panel 21 and the second side cavity 21-7 of the adjacent wall panel 21 together define a lower portion 231 of the column 23, specifically a lower portion 241 of the interior void 24, that is to be filled with concrete.

With reference to FIG. 3C, the abutment panel 22 may comprise a height H22, a width W22, and a depth D22. In one example, the abutment panel 22 may comprise an interior side 22*i* and an exterior side 22*e* with respect to the arch bridge system 10, in which the interior side 22*i* faces the opening or tunnel 60 beneath the arch 13 and the exterior side 22*e* faces the opposite direction of the interior side 22*i*. The interior side 22*i* may be substantially flat or planar, but the exterior side 22*e* may define a central cavity 22-8, as described in more detail below.

The abutment panel 22 may further comprise an interior panel 22-1 that is substantially planar and comprises a first interior side edge 22-1*a*, a second interior side edge 22-1*b*, a third interior side edge 22-1*c*, and a fourth interior side edge 22-1*d*. A first side wall 22-2 and a second side wall 22-3 may be formed on and extend from the interior panel 22-1 in a direction that is substantially perpendicular to the interior panel 22-1. The first and second side walls 22-2, 22-3 may be spaced inward from the first and second interior side edges 22-1*a*, 22-1*b* of the interior panel 22-1. The first side wall 22-2 may have an exterior surface 22-2*a* that is substantially coplanar with the third interior side edge 22-1*c* of the interior panel 22-1. The second side wall 22-3 may similarly have an exterior surface (not visible) that is substantially coplanar with the fourth interior side edge 22-1*d* of the interior panel 22-1. The first and second side walls 22-2, 22-3 may each comprise a respective inner edge 22-2*b*, 22-3*b* that is spaced inward from an inner surface (not labeled) of the interior panel 22-1, in which the inner edges 22-2*b*, 22-3*b* extend in a plane that is parallel to the inner surface of the interior panel 22-1.

With continued reference to FIG. 3C, the first side wall 22-2 of the abutment panel 22 may comprise a first exterior panel 22-4 that is formed on and extends from the first side wall 22-2 in a direction that is substantially perpendicular to the first side wall 22-2 and substantially parallel to the interior panel 22-1. The first exterior panel 22-4 may extend outward and may comprise a first exterior side edge 22-4*a* that is coplanar with the first interior side edge 22-1*a*. The second side wall 22-3 may similarly comprise a second exterior panel 22-5 that is formed on and extends from the second side wall 22-3 in a direction that is substantially perpendicular to the second side wall 22-3 and substantially parallel to the interior panel 22-1. The second exterior panel 22-5 may extend outward and may comprise a second exterior side edge 22-5*a* that is coplanar with the second interior side edge 22-1*b*.

The abutment panel 22 may further comprise a top edge 22*t*, a bottom edge 22*b*, a first support surface 22*a*, and a pair of second support surfaces 22*s*, in which the top edge 22*t*, the first support surface 22*a*, and the second support surfaces 22*s* face away from the foundation 16 when installed. The bottom edge 22*b* may face toward the foundation 16 when installed and may be defined by where the interior panel 22-1, the first and second side walls 22-2, 22-3, and the first and second exterior panels 22-4, 22-5 terminate in the downwards direction, i.e., along the direction defined by the height H22 of the abutment panel 22. The bottom edge 22*b* may reside in a single plane, i.e., all surfaces defining the bottom edge 22*b* may be coplanar with each other. A shape defined by the bottom edge 22*b* of the abutment panel 22 may mirror a shape defined by the top edge 21*t* of the subjacent wall panel 21, as seen in FIGS. 2, 3B, 3C, and 8B.

As shown in FIG. 3C, the top edge 22*t* of the abutment panel 22 may be defined by where the first and second exterior panels 22-4, 22-5 and an exterior portion of the first and second side walls 22-2, 22-3, i.e., a portion of the first and second side walls 22-2, 22-3 that is closer to the exterior side 22*e* than the interior side 22*i*, terminate in the upwards direction, i.e., along the direction defined by the height H22 of the abutment panel 22. The top edge 22*t* may be the highest surface of the abutment panel 22, i.e., a surface farthest away from the foundation 16 when installed, and may reside in first plane. The first support surface 22*a* may reside in second plane that is closer to the foundation 16 than the top edge 22*t*, such that the first support surface 22*a* may be recessed with respect to the top edge 22*t*. The first support surface 22*a* may be defined by where (i) an interior portion of the first and second side walls 22-2, 22-3, i.e., a portion of the first and second side walls 22-2, 22-3 that is closer to the interior side 22*i* than the exterior side 22*e*, and (ii) a portion of the interior panel 22-1 extending between the third and fourth interior side edges 22-1*c*, 22-1*d*, terminate in the upwards direction, i.e., along the direction defined by the height H22 of the abutment panel 22. The pair of second support surfaces 22*s* of each abutment panel 22 may reside in a third plane that is closer to the foundation 16 than the first support surface 22*a*, such that the second support surfaces 22*s* are recessed with respect to the first support surface 22*a*. One of the second support surfaces 22*s* may be defined by where portions of the interior panel 22-1 extending between the first interior side edge 22-1*a* and the third interior side edge 22-1*c*, and between the second interior side edge 22-1*b* and the fourth interior side edge 22-1*d*, terminate in the upwards direction. The first, second, and third planes in which the top edge 22*t*, the first support surface 22*a*, and the second support surfaces 22*s*, respectively, reside may be parallel to each other.

Figure 8B:
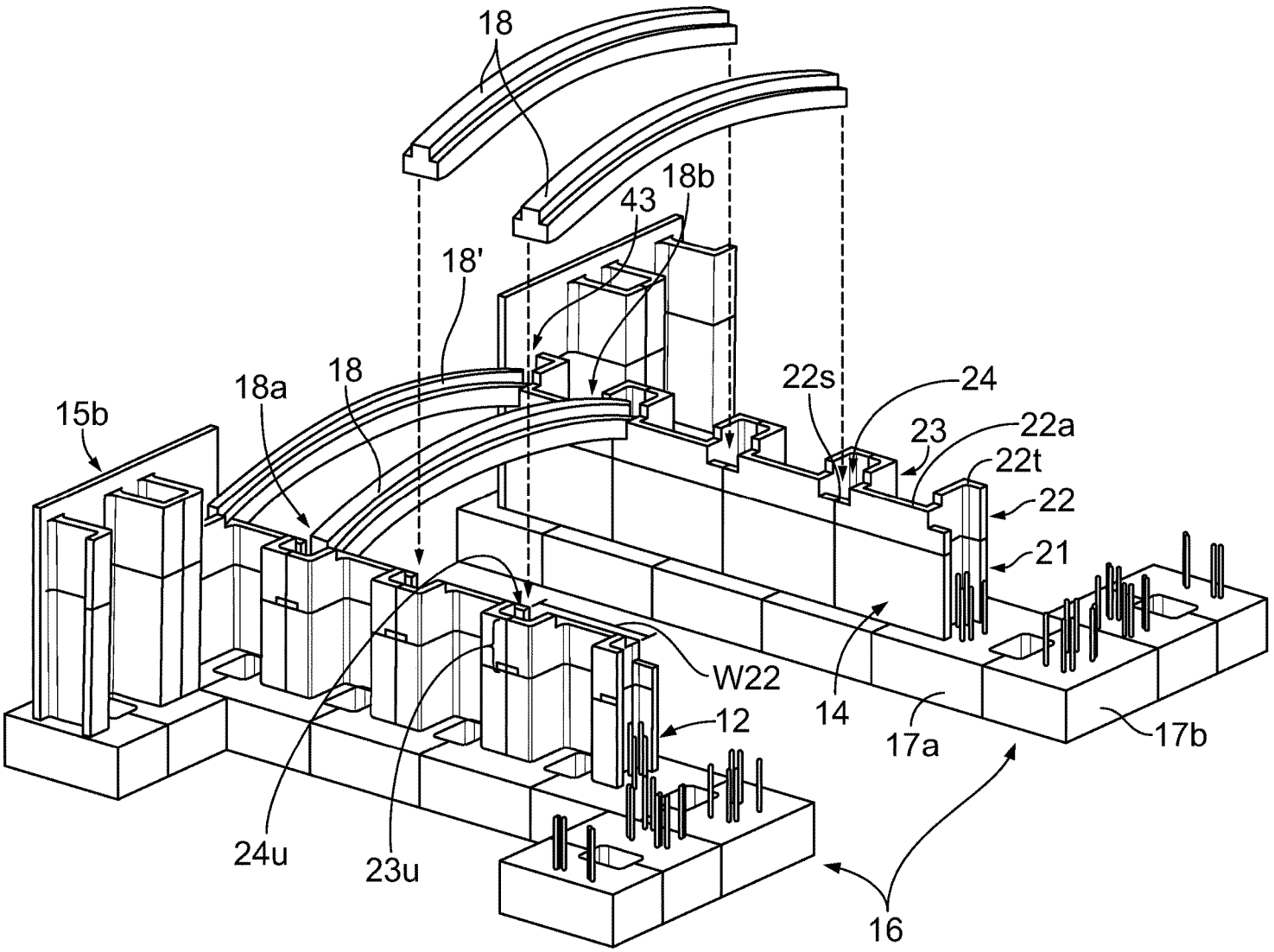

A first side cavity 22-6 may be defined by the interior panel 22-1, the first side wall 22-2, and the first exterior panel 22-4. A second side cavity 22-7 may be defined by the interior panel 22-1, the second side wall 22-3, and the second exterior panel 22-5. The central cavity 22-8 may be defined by the interior panel 22-1 and the first and second side walls 22-2, 22-3. With reference to FIGS. 3C and 8B, when one abutment panel 22 is adjoined to another abutment panel 22, the first side cavity 22-6 of one abutment panel 22 and the second side cavity 22-7 of the adjacent abutment panel 22 together define an upper portion 23*u* of the column 23, specifically an upper portion 24*u* of the interior void 24, that is to be filled with concrete. It can be seen in FIG. 8B that when the abutment panels 22 are installed on top of the wall panels 21, the respective central cavities 21-8, 22-8 of the wall and abutment panels 21, 22 are aligned in a vertical direction, i.e., along the direction defined by the heights H21, H22 of the wall and abutment panels 21, 22 (see FIGS. 3B and 3C).

In some examples, one or more components of the arch bridge system 10 may comprise shiplap or tongue & groove features to promote alignment of the components and/or to help with containment of field-cast concrete. Accordingly, one or more lateral joints (e.g., between adjacent wall panels and/or adjacent abutment panels) and/or vertical joints (e.g., between wall panels and foundation pieces and/or between wall panels and abutment panels) of the arch bridge system 10 may comprise shiplap and/or tongue & groove features.

Figure 7A:
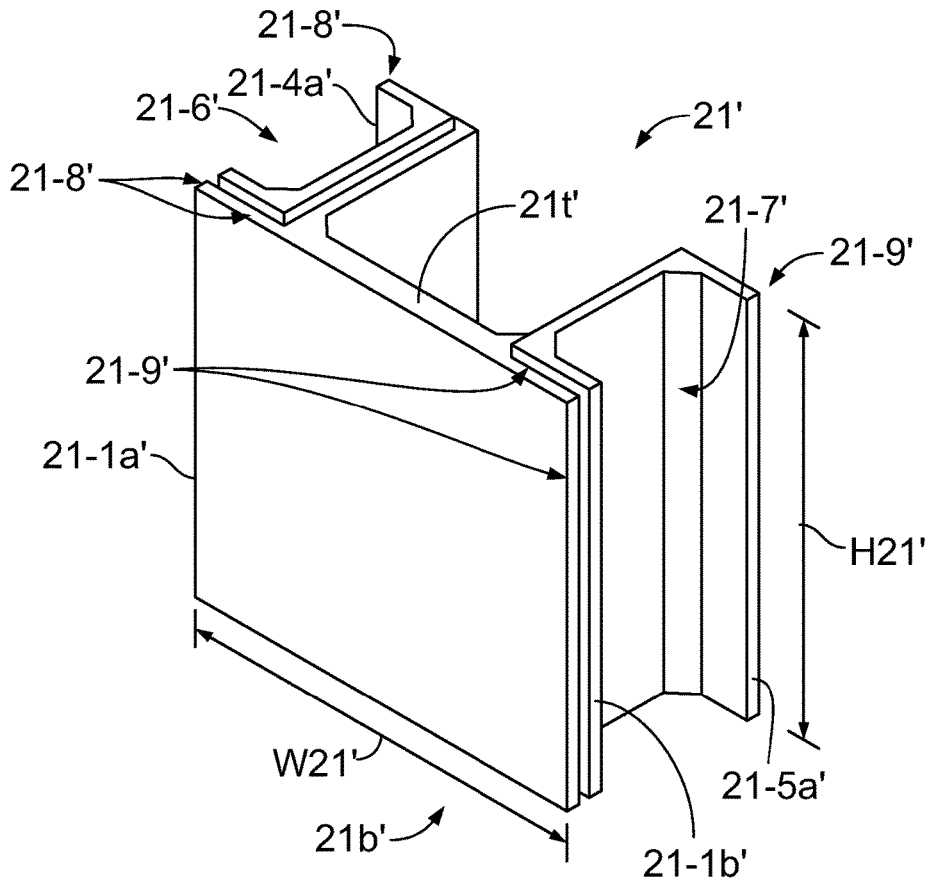
FIG. 7A is an illustration of a wall panel according to the present disclosure containing shiplap joint features for alignment and containment of field-cast concrete of a cast-in-place column.
Figure 7B:
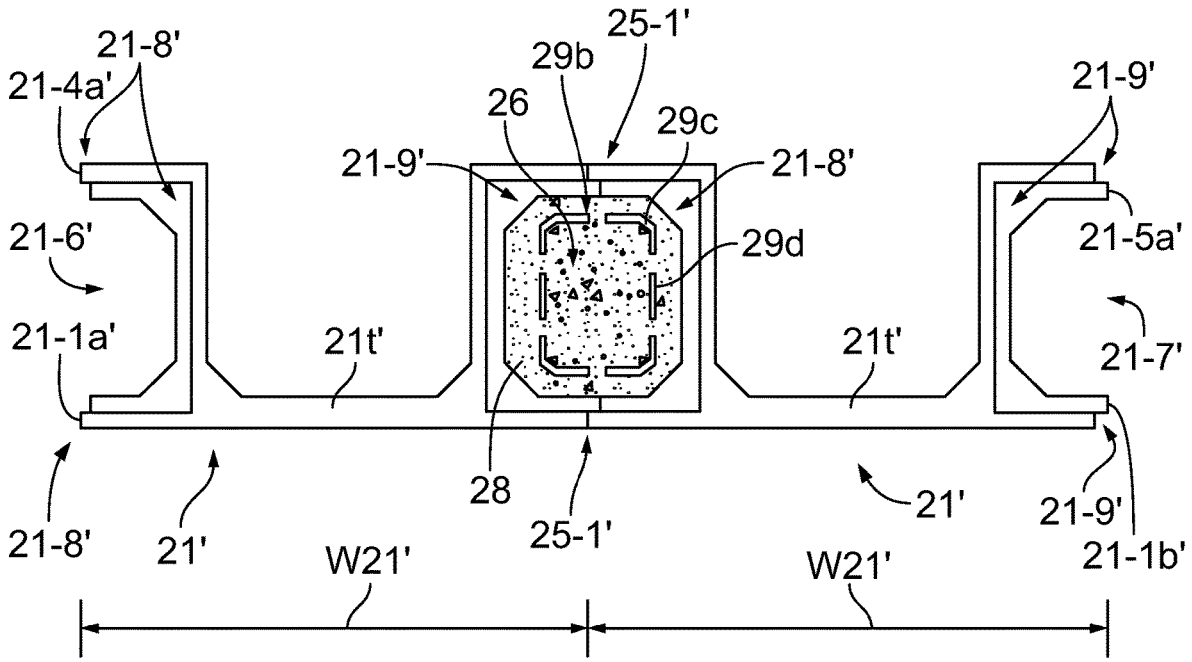
FIG. 7B is an illustration of two wall panels from FIG. 7A adjoined to form a column therebetween.
Figure 9:
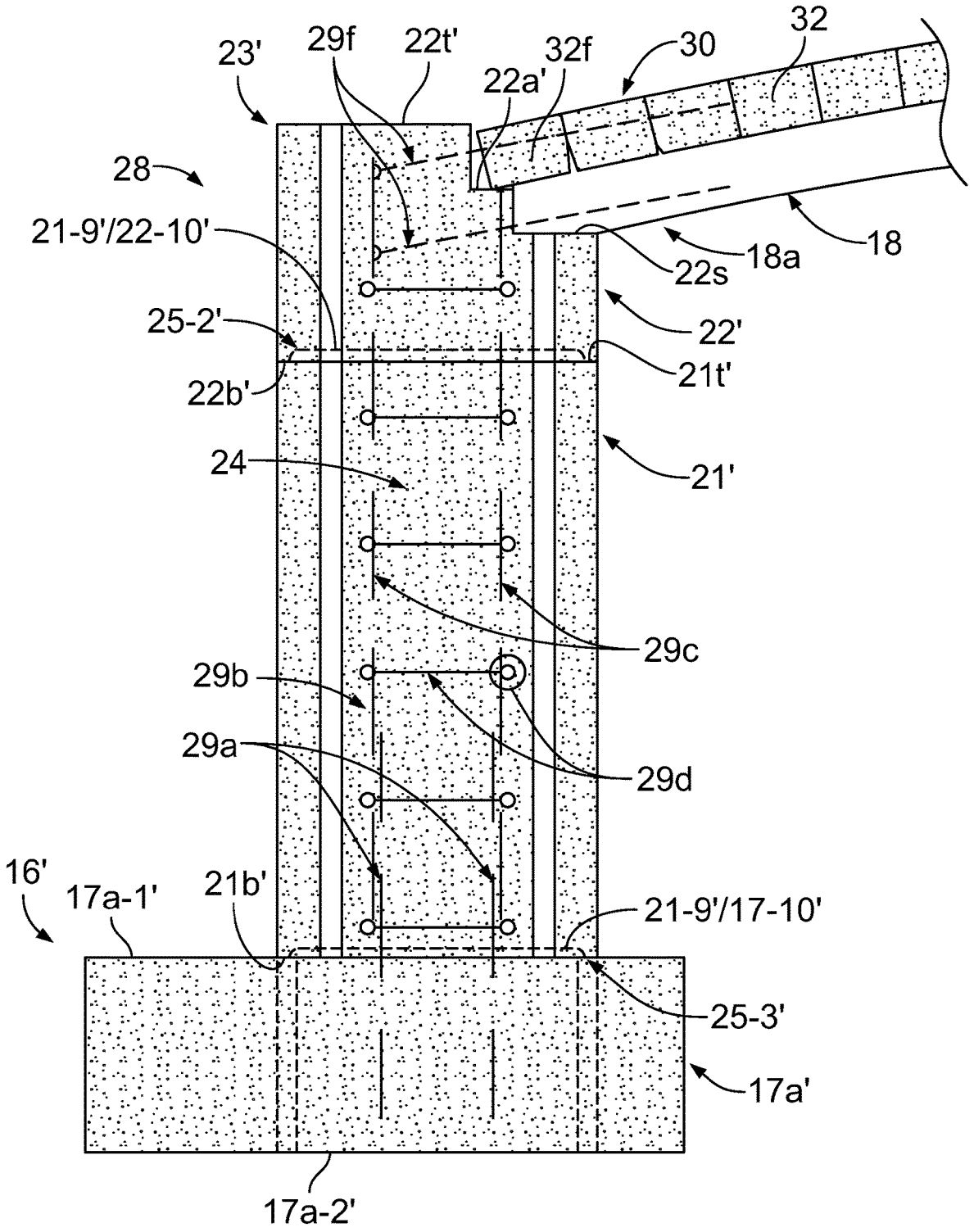
FIG. 9 is a cross-sectional view taken along line 9-9 in FIG. 2, in which the arch bridge system comprises components joined via shiplap joints according to the present disclosure.

An exemplary wall panel 21' with shiplap joint features is shown in detail in FIGS. 7A, 7B, and 9. A structure of the wall panel 21' may be substantially the same as the wall panel 21 previously discussed, with the primary difference being shiplap joint features formed on first and second interior side edges 21-1*a*', 21-1*b*', first and second exterior side edges 21-4*a*', 21-5*a*', a top edge 21*t*', and a bottom edge 21*b*' of the wall panel 21'. At least a portion of the first interior side edge 21-1*a*', the first exterior side edge 21-4*a*', the top edge 21*t*', and/or the bottom edge 21*b*' may comprise a shiplap joint feature 21-8'. In particular, the shiplap joint feature 21-8' may define at least a portion of a first side cavity 21-6' of the wall panel 21'. As shown in FIGS. 7A and 7B, the shiplap joint feature 21-8' may comprise a recess that extends inward along substantially an entirety of a height H21' of the first interior and exterior side edges 21-1*a*', 21-4*a*'; and/or an extension that extends outward from the top edge 21*t*' and extends around an upper perimeter of the first side cavity 21-6'. As discussed in more detail below with respect to FIG. 9, the shiplap joint feature 21-8' may also comprise a recess that extends inward from the bottom edge 21*b*' and is formed around a lower perimeter of the first side cavity 21-6'.

At least a portion of second interior side edge 21-1*b*', the second exterior side edge 21-5*a*', the top edge 21*t*', and the bottom edge 21*b*' may also comprise a shiplap joint feature 21-9'. In particular, the shiplap joint feature 21-9' may define at least a portion of a second side cavity 21-7' of the wall panel 21'. As shown in FIGS. 7A and 7B, the shiplap joint feature 21-9' may comprise a protrusion that extends outward along substantially an entirety of a height H21' of the second interior and exterior side edges 21-1*b*', 21-5*a*'; and/or an extension that extends outward from the top edge 21*t*' and extends around an upper perimeter of the second side cavity 21-7'. As discussed in more detail below with respect to FIG. 9, the shiplap joint feature 21-9' may also comprise a recess that extends inward from the bottom edge 21*b*' and is formed around a lower perimeter of the second side cavity 21-7'.

With reference to the two wall panels 21' adjoined along a width W21' direction in FIG. 7B, it can be seen that the shiplap joint feature 21-8' of one wall panel 21', specifically the recess extending inward along the first interior and exterior side edges 21-1*a*', 21-4*a*', is configured to receive and engage with the shiplap joint feature 21-9' of an adjacent wall panel 21', specifically the protrusion extending outward along the second interior and exterior side edges 21-1*b*', 21-5*a*', to form lateral shiplap joints 25-1' between the adjacent wall panels 21'. The lateral shiplap joint 25-1' formed by the interior side edges 21-1*a*', 21-1*b*' of the adjacent wall panels 21' may define an interior shiplap joint, and the lateral shiplap joint 25-1' formed by the exterior side edges 21-4*a*', 21-5*a*' may define an exterior shiplap joint.

With reference now to FIG. 9, a cross-section of a column 23' is depicted, along with a portion of an arch beam 18 and a foundation 16'. The column 23' comprises the wall panel 21' of FIGS. 7A and 7B and an abutment panel 22', and the foundation 16' comprises a foundation piece 17*a*', all of which each comprise one or more shiplap joint features. The column 23' is filled with concrete 26 to form a cast-in-place column 28, as described herein. One or more portions of a bottom edge 22*b*' of the abutment panel 22', e.g., portion(s) adjacent to first and second side cavities (not shown; see FIG. 3C), may comprise a shiplap joint feature 22-10' in the form of one or more recesses (because the cross-section is taken along a center of the column 23', only one recess is visible in FIG. 9, e.g., the recess formed in a portion of the bottom edge 22*b*' adjacent to the second cavity (see FIG. 3C)). The recess formed in the bottom edge 22*b*' of the abutment panel 22' may be configured to receive and engage with the portion of the shiplap joint feature 21-9' comprising the extension formed on the top edge 21*t*' of the subjacent wall panel 21' (e.g., the extension formed around the upper perimeter of the second side cavity 21-7' shown in FIGS. 7A and 7B) to form a vertical shiplap joint 25-2'. Although not visible, it is understood that another vertical shiplap joint may be formed by engagement between the extension formed around the upper perimeter of the first side cavity 21-6' of the wall panel 21' (see FIGS. 7A and 7B) and another corresponding recess formed in the bottom edge 22*b*' of the abutment panel 22' (e.g., a recess formed in a portion of the bottom edge 22*b*' adjacent to the first side cavity (see FIG. 3C)).

The first and second interior and exterior side edges (not shown; see FIG. 3C) of the abutment panel 22' may also comprise one or more shiplap joint features similar to those formed on the interior and exterior side edges 21-1*a*', 21-1*b*', 21-4*a*', 21-5*a*' of the wall panel 21' shown in FIGS. 7A and 7B, such that when the abutment panels 22' are adjoined along a width direction (not shown; see e.g., FIGS. 3C and 8B), the shiplap joint features formed on the interior and exterior side edges of adjacent abutment panels 22' similarly engage each other to form one or more lateral shiplap joints. A top edge 22*t*' of the abutment panel 22' may be substantially similar to the top edge 22*t* of the abutment panel 22 discussed above.

With continued reference to FIG. 9, the shiplap joint feature 21-9' of the wall panel 21' comprising the recess is depicted, in which the recess extends inward from the bottom edge 21*b*' and is formed around a lower perimeter of the second side cavity 21-7'. One or more portions of a top side 17*a*-1' of the foundation piece 17*a*', e.g., portion(s) adjacent to the channels (not shown; see FIG. 3A) may comprise a shiplap joint feature 17-10' in the form of one or more extensions (only one extension is visible, e.g., the extension formed on the portion of the top side 17*a*-1' adjacent to the second channel (see FIG. 3A)). The recess formed on the bottom edge 21*b'* of the superjacent wall panel 21' is configured to receive and engage with the corresponding extension formed on the top side 17*a*-1' of the subjacent foundation piece 17*a'* to form a vertical shiplap joint 25-3'. The extension of the foundation piece 17*a'* may be similar in structure to the extensions formed on the wall panel 21' shown in FIGS. 7A and 7B. Although not visible, it is understood that another vertical shiplap joint may be formed by engagement between another extension formed on the top side 17*a*-1' of the foundation piece 17*a'* (e.g., an extension formed on the portion of the top side 17*a*-1' adjacent to the first channel (see FIG. 3A)) and another corresponding recess formed in the bottom edge 21*b'* of the wall panel 21' (e.g., a recess formed around the lower perimeter of the first side cavity 21-6' (see FIGS. 7A and 7B)). A bottom side 17*a*-2' of the foundation piece 17*a'* may be substantially similar to the bottom side 17*a*-2 of the foundation piece 17*a* discussed earlier. Although not shown, it should be understood that the foundation piece 17*b* of FIG. 3A may also include similar shiplap joint features that form one or more vertical shiplap joints and that one or more lateral shiplap joints may also be formed between adjoining foundation pieces 17*a'* and/or 17*b*.

The above-described shiplap features may be beneficial for forming joints 25-1', 25-2', 25-3' capable of withstanding temporary hydrostatic pressure from wet concrete and may help prevent wet concrete from squeezing out of the joints 25-1', 25-2', 25-3'. These shiplap features may also help to generally promote vertical and/or lateral stability of the arch bridge system 10 during and after installation and particularly prior to filling the column 23' with concrete 26. The shiplap features may further be beneficial during installation of the arch bridge system 10 by providing the modified precast components with engageable features that may, for example, help to determine where the wall panels 21' should be placed on the foundation 16' and/or aid in the alignment of the wall panels 21' and abutment panels 22' with respect to each other.

With reference to FIGS. 1-2, the arch bridge system 10 may further comprise a plurality of arch beams 18 spaced along the width W10 and spanning the length L10. The arch beams 18 may be precast components and may be tied together by mechanical connections as necessary during construction, or permanently where required. The arch beams 18 may advantageously define the shape of the arch 13 and may provide stability during construction. Further, the arch beams 18 may provide support for a deck 19 of the arch bridge system 10, as described herein. Monolithic arch beams 18 spanning the length L10, as opposed to a multi-piece arch beam or equivalent structure, may be advantageous in that precise joints along the span are not required to form the shape of the arch 13. Monolithic arch beams 18 may also provide greater strength to the arch bridge system 10. In the example shown, the arch beams 18 may be arcuate in shape. In other examples (not shown), the arch bridge system 10 may comprise linear beams. Utilizing linear "flat slabs" rather than arcuate-shaped arch beams may be beneficial for "low profile" bridge sites where the vertical distance, e.g., the distance from a stream bed to a road surface, is limited.

Figure 4A:
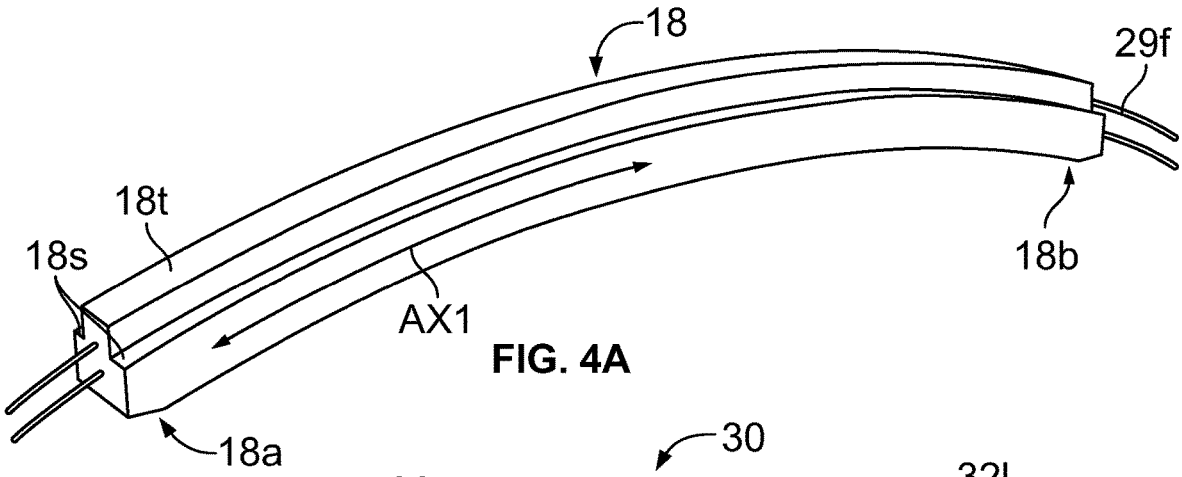

As shown in FIGS. 2 and 4A, each arch beam 18 may comprise a top surface 18*t*, a pair of support surfaces 18*s*, a first end 18*a*, and a second end 18*b* opposite the first end 18*a*. The top surface 18*t* and support surfaces 18*s* may each extend along a longitudinal axis AX1 of the arch beams 18 from the first end 18*a* to the second end 18*b* and may face away from the foundation 16 when installed. In the example shown, the top and support surfaces 18*t*, 18*s* each comprise an arcuate shape that generally follows the overall arcuate shape of the arch beam 18. The support surfaces 18*s* may comprise shoulders that are recessed with respect to the top surface 18*t*, such that a cross-section of the arch beam 18 may define a shape similar to a capital "T." The support surfaces 18*s* may provide a supportive function for other elements, which may also be included as part of the arch 13, as described herein in more detail.

The first and second ends 18*a*, 18*b* of each arch beam 18 may be supported at the first and second side walls 12, 14, respectively, at upper portions 23*u* of the columns 23, as shown in FIG. 8B (see also FIG. 9). When the arch bridge system 10 is constructed, the abutment panels 22 are aligned such that one of the pair of second support surface 22*s* of one abutment panel 22 is adjacent to and aligned with one of the pair of second support surfaces 22*s* of an adjacent abutment panel 22 to define a planar bearing surface capable of supporting one of the arch beams 18. The first end 18*a* of each arch beam 18 is received and supported by the second support surfaces 22*s* of adjacent abutment panels 22 in the first side wall 12, and the second end 18*b* of each arch beam 18 is received and supported by the second support surface 22*s* of adjacent abutment panels 22 in the second side wall 14. As best seen in FIG. 4A, portions of a bottom surface (not labeled) of the arch beam 18 (i.e., a surface opposite the top surface 18*t*) near the first and second ends 18*a*, 18*b* of the arch beam 18 may be flattened or planar, such that the arch beam 18 rests securely on the planar bearing surface defined by the second support surfaces 22*s* of the adjacent abutment panels 22 and resists rotation of the arch beam 18 and deformation of the arch 13. Following installation, a portion of the support surfaces 18*s* near the first and second ends 18*a*, 18*b* may be generally coplanar with the first support surface 22*a* of the abutment panel 22 (see FIG. 8B; see also FIG. 9). The arch beams 18 may comprise arch beam dowels 29*f* extending lengthwise from each of the ends 18*a*, 18*b* (see FIGS. 4A and 9). The arch beam dowels 29*f* may comprise rebar or other reinforcing material as described herein that is embedded within the arch beam 18 during formation. As best seen in FIG. 9, the arch beam dowels 29*f* may extend into the interior void 24 of the column 23' to form a stronger connection between the arch beam 18 and the side walls 12, 14, as described herein, specifically between the arch beam 18 and the abutment panel 22'.

Figure 4B:
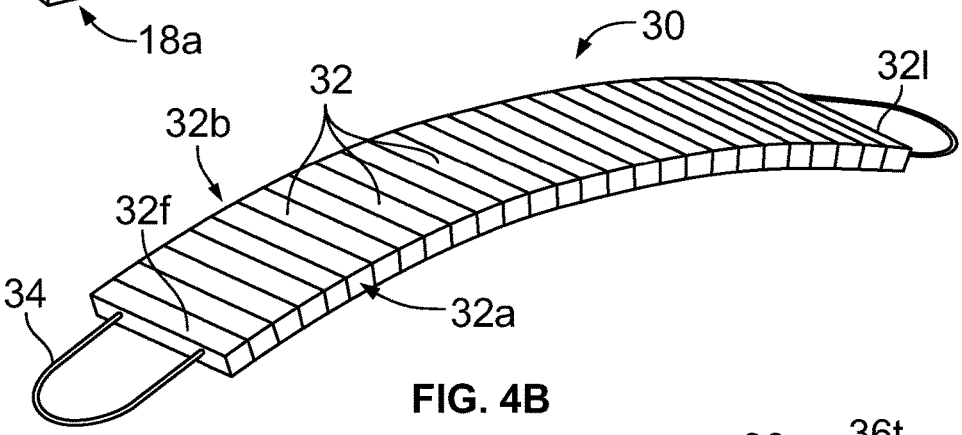
Figure 8C:
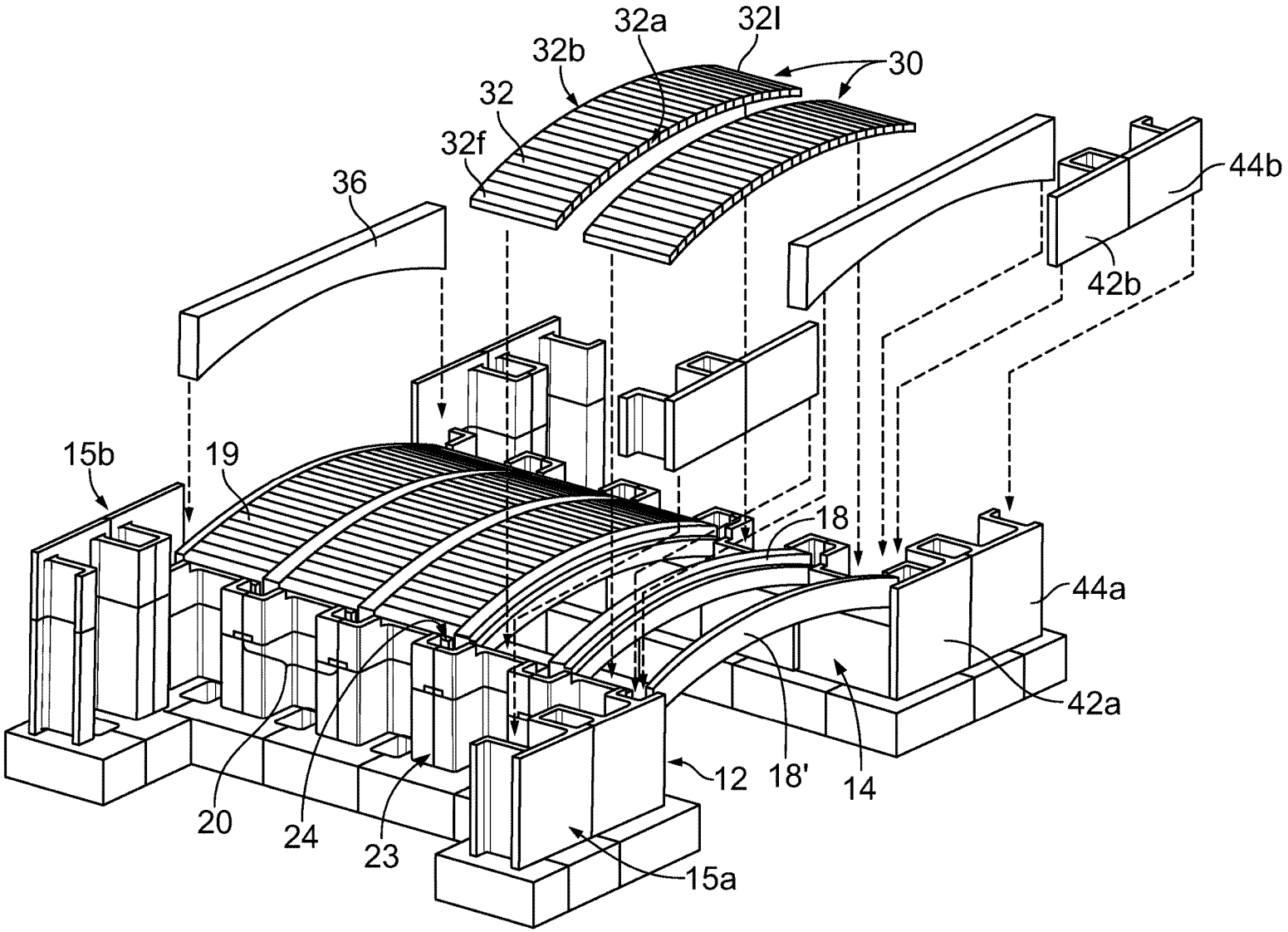

The deck 19 of the arch bridge system 10 as shown in FIGS. 1 and 2 may comprise the plurality of arch beams 18 discussed above, along with decking panel assemblies 30 positioned between, and supported by, adjacent arch beams 18. As shown in FIGS. 4B and 8C, each decking panel assembly 30 may comprise a plurality of decking panels 32. In some examples, the decking panels 32 may comprise precast concrete. In other examples, the decking panels 32 may comprise a metal or metal alloy, a composite such as fiberglass, a plastic, or other materials or combination(s) of materials. Each decking panel 32 may have a first decking panel end 32*a* and a second decking panel end 32*b*. The first decking panel end 32*a* of each decking panel 32 may be supported by one of the plurality of arch beams 18, and the second decking panel end 32*b* of each decking panel 32 may be supported by an adjacent one of the plurality of arch beams 18. Specifically, the first and second decking panel ends 32*a*, 32*b* may be supported by the support surfaces 18*s* of the respective arch beams 18.

Further, as shown in FIGS. 4B, 8C, and 9, each decking panel assembly 30 may comprise a first decking panel 32*f* and a last decking panel 32*l* that are positioned at the first and second side walls 12, 14, respectively. The first decking panel 32*f* may be supported by the first support surface 22*a* of one of the abutment panels 22 of the first side wall 12, and the last decking panel 32*l* may be supported by the first support surface 22*a* of one of the abutment panels 22 of the second side wall 14 (see also FIGS. 8B and 8C). In particular, a region (not labeled) between the first and second decking panel ends 32*a*, 32*b* of the first and last decking panels 32*f*, 32*l* may be supported by the first support surface 22*a*.

Because the arch beams 18 ensure a correct radius shape of the arch 13, precise joints between adjacent decking panels 32 within each decking panel assembly 30 are generally not required. As shown in FIG. 4B, the plurality of decking panels 32 of each decking panel assembly 30 may be connected or tied together with one or more rods or cables 34 so that each decking panel assembly 30 can be picked up and moved as one unit, e.g., by inserting a forklift or other implement through the rod(s)/cable(s) 34 at either end of the decking panel assembly 30 and lifting the decking panel assembly 30 by its ends. Upon installation, the decking panel assembly 30 flexes and conforms to the shape of the arch 13 as defined by the arch beams 18 (see FIG. 8C; although the uninstalled decking panel assemblies 30 are depicted in FIG. 8C as having a curvature similar to the installed decking panel assemblies 30, it should be understood that the uninstalled decking panel assemblies 30 may be flexed in a direction opposite to that shown). Cable-connected decking panel assemblies 30 may provide flexible concrete decking that is lightweight, easy to build, and inexpensive. All or part of the rod(s)/cable(s) 34 extending between and/or beyond the first and last decking panels 32*f*, 32*l* may be removed or left in place. In some examples, the rod(s)/cable(s) 34 may be left in place when the deck 19 of the arch bridge system 10 is covered with backfill once the arch bridge system 10 has been constructed. In other examples, e.g., in circumstances in which the ends of the decking panel assemblies 30 remain exposed after the arch bridge system 10 is complete, it may be preferable to remove the rod(s)/cable(s) 34. The decking panels 32 may optionally be fastened (not shown) to the arch beams 18 to provide lateral stability during construction, or permanently where required. Following installation, no mechanical connection would be required between the decking panels 32 of the decking panel assemblies 30.

Figure 4D:
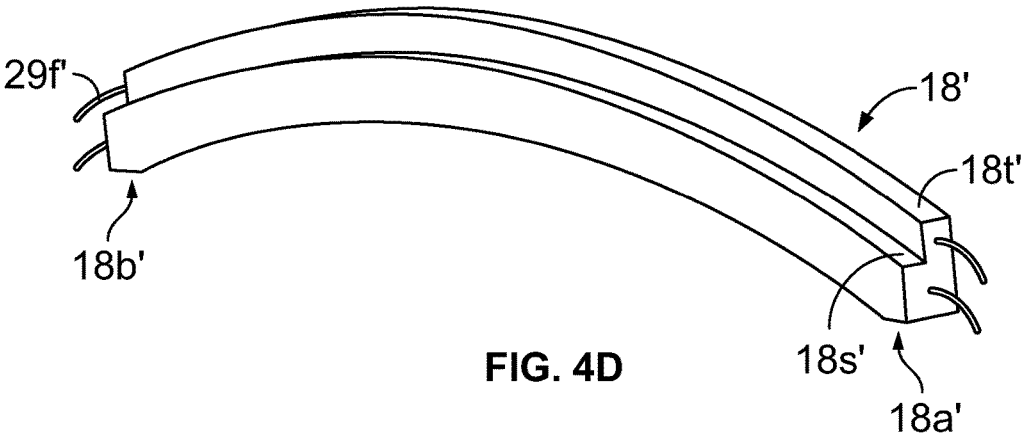
Figure 5:
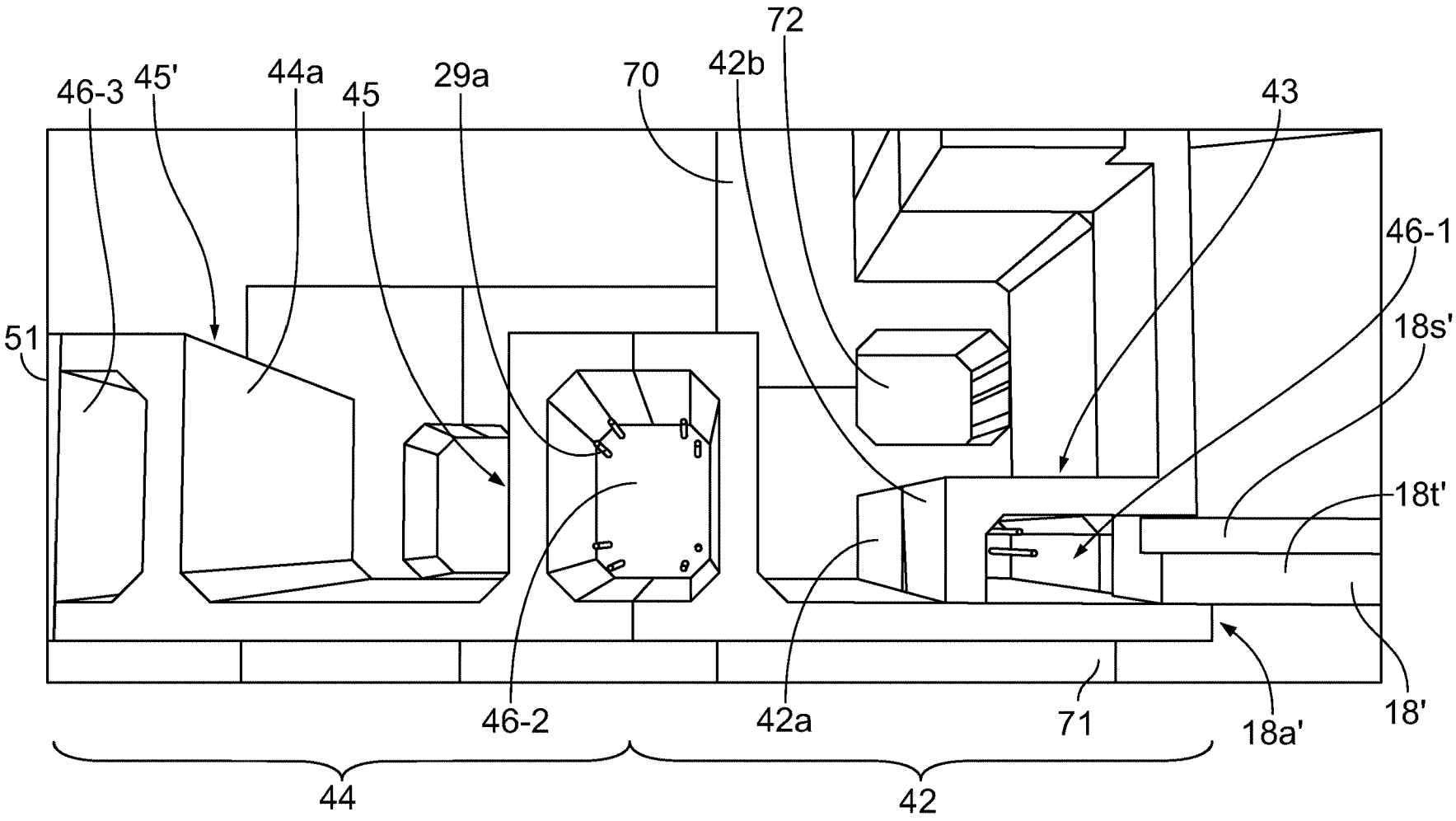
FIG. 5 is a top perspective view of a portion of an end wall of the arch bridge system of FIG. 1.
Figure 6A:
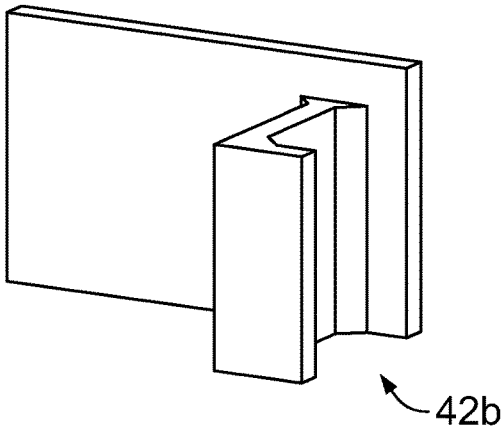
FIGS. 6A-6D are illustrations of additional individual precast components of the arch bridge system of FIG. 1.
Figure 6B:
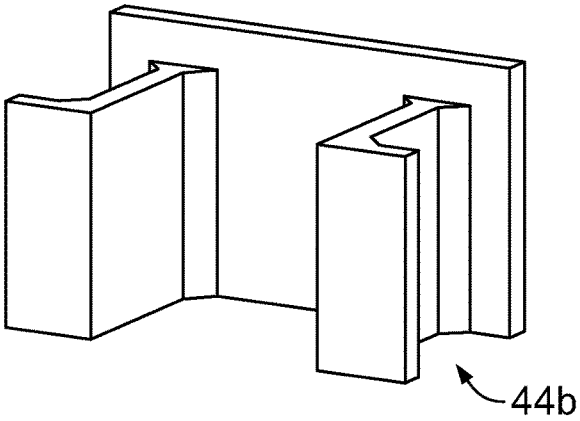
Figure 6C:
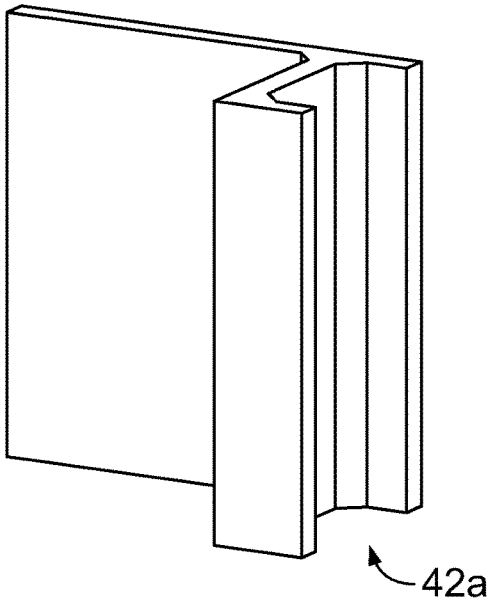
Figure 6D:
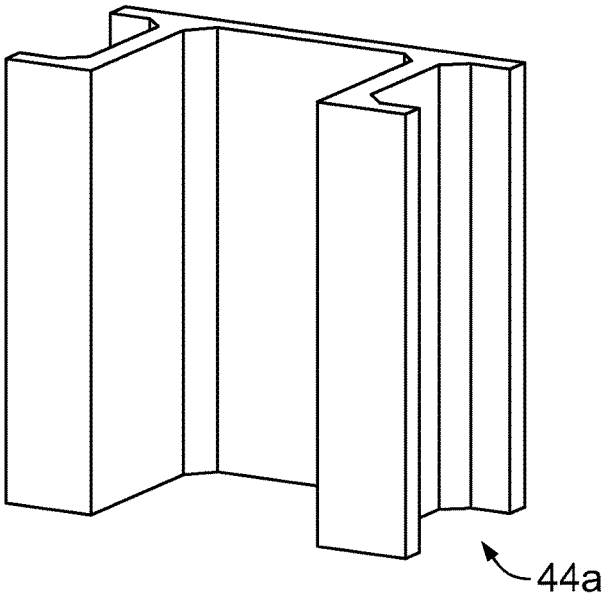

With reference to FIGS. 1-2, the first and second side walls 12, 14 may terminate at a first end wall 15*a* and a second end wall 15*b* of the arch bridge system 10. Arch beams 18' most proximate to the first and second end walls 15*a*, 15*b* (referred to as end wall arch beams 18') may have a slightly different structure than the arch beams 18 as a result of their position within the arch bridge system 10, as can be seen in FIGS. 4D, 5, and 8B. The end wall arch beam 18' may comprise a top surface 18*t'* and one support surface 18*s'* that faces toward the center of the arch bridge system 10. The support surface 18*s'* may be recessed with respect to the top surface 18*t'* of the end wall arch beam 18'. The other side of the end wall arch beam 18', which faces away from the arch bridge system 10, may be substantially planar. The end wall arch beam 18' may further comprise arch beam dowels 29*f'* extending lengthwise from first and second ends 18*a'*, 18*b'* of the end wall arch beam 18'.

With reference to FIGS. 2, 5, and 6A-6D, the first and second end walls 15*a*, 15*b* may comprise end wall sections 44 and corner end wall sections 42. The end wall sections 44 may comprise one or more end wall panels 44*a* and an end wall top panel 44*b*. The corner end wall sections 42 may comprise one or more corner end wall panels 42*a* and a corner end wall top panel 42*b*. Similar to the columns 23, an end wall column 45 may be formed between corner end wall sections 42 and end wall sections 44, and a corner column 43 may be formed between adjacent corner end wall sections 42 and side wall sections 20 of each side wall 12, 14 that are positioned most proximate to the first and second end walls 15*a*, 15*b*. The corner column 43 and end wall column 45 may define interior voids 46-1, 46-2, respectively, similar to the interior voids 24 of the first and second side walls 12, 14, and may be filled with concrete to form cast-in-place columns (not separately labeled) similar to the cast-in-place columns 28 of the first and second side walls 12, 14. Further, upper portions (not labeled) of the corner columns 43 may support the first and second ends 18*a'*, 18*b'* of the end wall arch beams 18' (see FIG. 8C) in a manner similar to that in which the first and second ends 18*a*, 18*b* of the arch beams 18 are supported by columns 23. As best seen in FIG. 4D, a portion of a bottom surface (not labeled) of the arch beam 18' (i.e., a surface opposite the top surface 18*t'*) near the first and second ends 18*a'*, 18*b'* may be flattened or planar similar to the arch beam 18. Thus, when the corner columns 43 are filled with concrete, the end wall arch beams 18' are locked in place, e.g., at least in part via the arch beam dowels 29*f'*. Furthermore, as shown in FIG. 5, a cavity on the end of the end wall sections 44 that faces away from the opening or tunnel 60 of the arch bridge system 10 may form a half-column 45', which when adjoined with a form 51, creates an interior void 46-3. Filling the interior void 46-3 with concrete creates cast-in-place half columns (not shown).

Figure 4C:
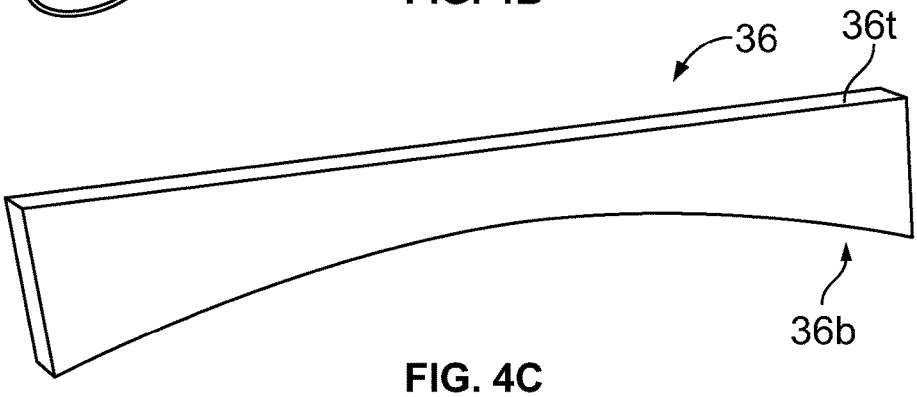

As shown in FIGS. 1, 2, and 4C, the arch bridge system 10 may further comprise headwalls 36 positioned above and supported by the end wall arch beams 18' and/or a portion of a decking panel assembly 30 most proximate to the first and second end walls 15*a*, 15*b*. The headwalls 36 may comprise a flat top surface 36*t* and a curved bottom surface 36*b*, in which the curved bottom surface 36*b* substantially corresponds to the curvature of the top and support surfaces 18*t'*, 18*s'* of the end wall arch beam 18'. The headwalls 36 may span between the corner end wall top panels 42*b*, in which the top surface 36*t* of the headwall 36 may be flush with a top surface (not labeled) of the corner end wall top panels 42*b*.

The number and/or dimensions of one or more components of the arch bridge system 10 may be altered to obtain the desired overall width W10, length L10, and/or height (not labeled) of the arch bridge system 10. For example, the height, width, and/or depth of one or more of the precast wall and/or abutment panels 21, 22, respectively, as described herein may be customized to achieve the desired dimensions of the arch bridge system 10. A length of the arch beams 18, 18' (not labeled; measured between the first and second ends), as well as a width (not labeled; measured between the outer surfaces of the support surfaces) and/or height (not labeled; measured between the top and bottom surfaces) may also be varied to achieve the desired dimensions of the arch bridge system 10. The number and/or width of the decking panel assemblies 30 (not labeled; measured between the first and second decking panel ends) may further be altered to achieve the desired dimensions of the arch bridge system 10. For instance, a narrow arch bridge system may include one decking panel assembly 30 and two end wall arch beams 18', while a wider arch bridge system as shown in FIGS. 1 and 2 may include multiple decking panel assemblies 30 and arch beams 18, 18'.

The configuration of the arch bridge system 10 may be altered to provide the required strength. For example, the number of arch beams 18 and spacing therebetween may be varied to increase the strength of the arch bridge system 10. An arch bridge system that must withstand a large amount of weight, e.g., from heavy vehicles, may include more robust arch beams 18, 18' of increased width and/or height and/or arch beams 18, 18' that are spaced more closely together, with narrower decking panel assemblies 30 supported by the arch beams 18, 18'. A thickness (not labeled) of one or more of the decking panels 32, the wall panels 21, the abutment panels 22, etc. may also be increased to provide additional strength.

With reference to FIGS. 2 and 9, following installation of the above-described components of the arch bridge system 10, the interior voids 24 of the columns 23, 23' may be filled with concrete 26 to form cast-in-place columns 28. The cast-in-place columns 28 may be reinforced concrete that includes the foundation dowels 29*a* extending therein from the foundation piece 17*a'* (see also FIG. 3A) and/or the arch beam dowels 29*f* extending therein from the arch beams 18. As shown in FIGS. 7B and 9, the cast-in-place columns 28 may optionally comprise a reinforcing cage 29*b* that extends vertically within and through at least a portion of the cast-in-place columns 28. The reinforcing cage 29*b* may comprise rebar or other reinforcing material and may be placed in the interior void 24 of the columns 23, 23' after the precast components are installed and prior to filling with concrete 26. The reinforcing cage 29*b* may comprise vertically extending longitudinal bars 29*c* and lateral ties 29*d* connecting the longitudinal bars 29*c*. The reinforcing cage 29*b* may be placed over the foundation dowels 29*a* and may help to strengthen the cast-in-place columns 28 and the overall vertical connections between the abutment panels 22/22', wall panels 21, 21', and foundation 16, 16'.

Upon forming the cast-in-place columns 28, a rigid, fixed, monolithic connection between the foundation 16 (including deep foundation systems), the first and second side walls 12, 14, and the plurality of arch beams 18 may be achieved. This monolithic connection allows the foundation 16, including deep foundation systems, to be made continuous with the side walls 12, 14 and the arch 13. Accordingly, once the cast-in-place column 28 closure pours are completed, the arch beams 18 that are supported at the upper portions 23*u* of columns 23 of each side wall 12, 14 become locked in place, providing a "fixed-head" pile condition. This fixed-head pile condition significantly reduces the bending stress mid-span of the arch 13 and is beneficial for resisting lateral arch deformation. This fixed-head pile condition can be important for relatively flat arches.

Formation of the cast-in-place columns 28 may also permanently confine the decking panel assemblies 30 by locking in the first and last decking panel 32*f*, 32*l* of each decking panel assembly 30. Filling the interior voids 24 of the columns 23 with concrete 26 forms a rigid connection between the arch beams 18 and the first and second side walls 12, 14 and locks in the first and second decking panel ends 32*a*, 32*b* of each of the first and last decking panels 32*f*, 32*l*. A soil backfill in combination with the cast-in-place columns 28 would further permanently confine each decking panel 32 and thus each decking panel assembly 30.

Figure 10:
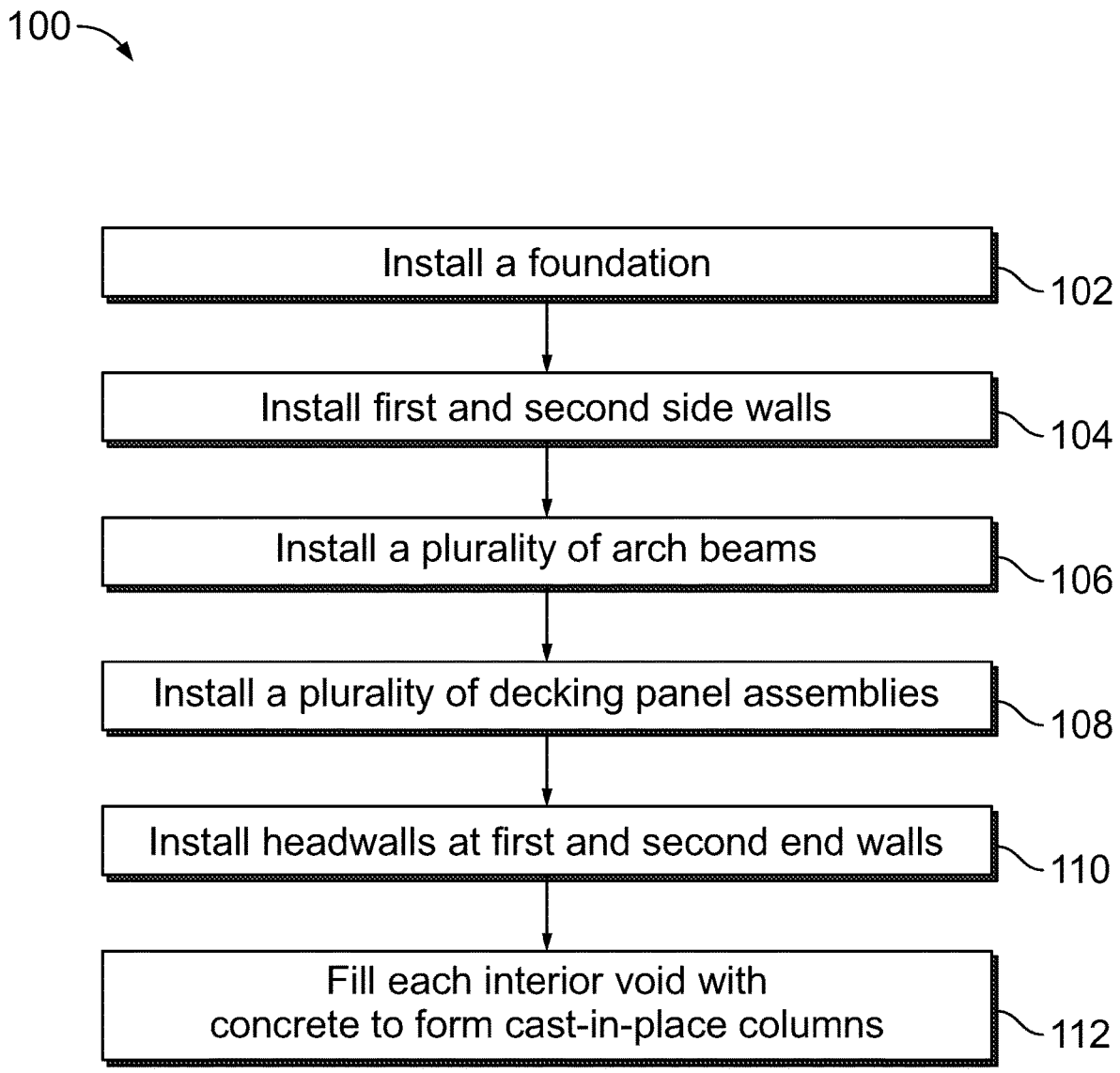
FIG. 10 depicts a flow chart illustrating methods for producing an arch bridge system according to the present disclosure.

A method 100 for producing the arch bridge system 10 is illustrated in the flow diagram of FIG. 10. A first step 102 in the method 100 may include installing a foundation. The foundation may include precast modular foundation pieces as described herein, which once installed correctly, may help to ensure correct installation of the rest of the arch bridge system. The foundation may also take the form of strip/spread footings and/or slab/mat foundations bearing directly on soil or bedrock. The foundation may also include a deep foundation system such as driven piles or drilled shafts, as described herein. Next, in step 104, a first side wall and a second side wall may be installed, in which the first and second side walls extend a width of the system and are spaced apart with respect to each other to define a length of the system therebetween. The first and second side walls may each include a plurality of side wall sections that are supported by the foundation and aligned along the width of the system. Adjacent side wall sections may form a column therebetween, with the column including an interior void extending along a height of the column. Installing the first and second side walls sections may include installing, for each side wall section, a wall panel that is supported by the foundation and an abutment panel supported by the wall panel.

In step 106, a plurality of arch beams may be installed, in which the arch beams span the length of the system and are spaced along the width of the system. The plurality of arch beams each have a first end and a second end opposite the first end, with the first end being supported at the first side wall at an upper portion of one of the columns and the second end being supported at the second side wall at an upper portion of another one of the columns. The method 100 may include installing a plurality of decking panel assemblies at step 108, in which each decking panel assembly includes a plurality of decking panels. Each decking panel may have a first decking panel end and a second decking panel end, in which the first decking panel end is supported by one of the plurality of arch beams and the second decking panel end is supported by an adjacent one of the plurality of arch beams. The plurality of decking panels of each decking panel assembly may be connected with at least one cable extending along the length of the system. The first and second side walls may terminate at a first end wall and a second end wall of the system, and at step 110, the method 100 may further include installing a headwall at each of: (i) one of the plurality of arch beams most proximate to the first end wall; and (ii) one of the plurality of arch beams most proximate to the second end wall. In step 112, each interior void of the columns may be filled with concrete to form cast-in-place columns defining rigid, fixed, monolithic connections between the foundation, the first and second side walls, and the plurality of arch beams, after which the method may conclude.

FIG. 8A illustrates an example of the method 100 of FIG. 10 at a point within step 104 in which the foundation 16 comprising one or more foundation pieces 17*a* and/or 17*b* is completed (step 102) and installation of the first and second side walls 12, 14 is in progress. In particular, several wall panels 21 have been installed on top of the foundation 16, in which each wall panel 21 will form a portion of a side wall section 20 (see FIGS. 1 and 2).

FIG. 8B illustrates an example of the method 100 at a point within step 106 in which installation of first and second side walls 12, 14 (including walls panels 21 and abutment panels 22) is completed (step 104) and installation of the arch beams 18 is in progress (a portion of one end wall 15*b* is also shown). As described herein, each abutment panel 22 may include a top edge 22*t*, a bottom edge 22*b* opposite the top edge 22*t*, a first support surface 22*a*, and a pair of second support surfaces 22*s*, in which the top edge 22*t*, the first support surface 22*a*, and the second support surfaces 22*s* may face away from the foundation 16. The first support surface 22*a* may be closer to the foundation 16 than the top edge 22*t*, and the second support surfaces 22*s* may be closer to the foundation 16 than the first support surface 22*a*.

Also as described herein, a column 23 may be formed between adjacent side wall sections 20, in which the column 23 comprises an interior void 24 extending the height H23 of the column 23. The first and seconds ends 18*a*, 18*b* of the arch beams 18 may be supported at upper portions 23*u* of the columns 23 of the first and second side walls 12, 14, respectively. In particular, the first and second ends 18*a*, 18*b* of the arch beams 18 may be supported by ones of the pair of second support surfaces 22*s* of adjacent abutment panels 22 of the first side wall 12 and second side wall 14, respectively. The first and second ends 18*a*', 18*b*' of the end wall arch beams 18' are similarly supported at upper portions (not labeled) of the corner columns 43.

FIG. 8C illustrates an example of the method 100 of FIG. 10 at a point within steps 108 and 110 in which installation of the arch beams 18/18' is completed and installation of the decking panel assemblies 30 and the end walls 15*a*, 15*b* is in progress, including installation of the headwalls 36. As described herein, the decking panel assemblies 30 each comprise a plurality of decking panels 32 having a first decking panel end 32*a* and a second decking panel end 32*b* (see FIG. 4C). The first decking panel end 32*a* of each decking panel 32 may be supported by one of the arch beams 18, and the second decking panel end 32*b* of each decking panel 32 may be supported by an adjacent one of the plurality of arch beams 18, as shown in FIG. 8C. Each of the plurality of decking panel assemblies 30 comprises a first decking panel 32*f* and a last decking panel 32*l*, in which the first decking panel 32*f* may be supported by the first support surface 22*a* of one of the abutment panels 22 of the first side wall 12 and the last decking panel 32*l* may be supported by the first support surface 22*a* of one of the abutment panels 22 of the second side wall 14. Also as described herein, headwalls 36 may be installed at the first and second end walls 15*a*, 15*b* of the arch bridge system 10, in which the headwalls 36 are supported by the end wall arch beams 18' and/or a portion of the decking panel assembly 30 most proximate to the first and second end walls 15*a*, 15*b*. The interior voids 24 of columns 23, 23' may be filled with concrete 26 to form cast-in-place columns 28, as shown in FIGS. 7B and 9, in which the cast-in-place columns 28 define rigid, fixed, monolithic connections between the foundation 16, the first and second side walls 12, 14, and the plurality of arch beams 18. The plurality of decking assemblies 30 may be permanently confined by formation of the cast-in-place columns 28. An optional soil backfill (not shown) may then be placed on top of the arch bridge system 10 to tie in the structure with the surrounding environment.

An alternative method of production may be utilized when a particular application requires the arch bridge system to have tall side walls with each side wall section containing two or more wall panels stacked on top of each other. The method may be substantially similar to the method 100 described above, in which installing the first and second side walls may comprise installing first and second side wall sections each comprising two or more wall panels. When tall side walls are needed, filling the interior voids of the columns may be performed in stages. According to this alternative method of production, following installation of the foundation, at least one course of wall panels may be installed on the foundation. Next, lower portions of the columns, which have been formed via the at least one course of wall panels, may be filled with concrete. Next, at least one additional wall panel and the abutment panel of each wall section may be installed. Following the installation of the remaining components of the side wall sections, the arch beams and decking panels assemblies may be installed, as described above. The upper portion of the columns may be filled with concrete to complete the cast-in-place columns and to create rigid, fixed, monolithic connections between the foundation, the first and second side walls, and the plurality of arch beams.

The alternative method of production described above may also be advantageous when dewatering pumps and/or temporary water diversion measures need to be removed as quickly as possible. Additionally, scour protection and/or stream restoration work may be required in the stream bed after the first course of wall panels is installed and the lower portions of the columns are filled with concrete. The two-step process of filling the interior voids of columns with concrete in the alternative method may be necessary for these actions to be performed in some situations.

It is briefly noted here that the above description of the arch bridge system 10 and method 100 of producing the arch bridge system 10 may include several components and corresponding installation steps that are not required and/or may be modified without departing from the scope of the invention defined in the appended claims. For example, one or more of the wall panels, the abutment panels, the foundation pieces, etc. may be implemented as a single (monolithic) component. Modular side wall sections may comprise a smaller or greater number of components. Similarly, the decking panel assemblies are provided only as an example for how regions between adjacent arch beams may be constructed.

Numerous benefits are possible with the disclosed arch bridge system and method of production thereof. The disclosed arch bridge system and methods of production thereof permits use of precast pieces, such that no forms have to be built in the field, and provides a modular system with improved scalability, reliability, cost efficiency, and ease and speed of construction. The arch bridge system may consist fully or partially of these smaller, lightweight precast components, which may be installed with lightweight equipment and increases the speed and reduces the cost of installing the system. Any of the precast pieces may be formed with embedded rebar or other reinforcing material and may be easily secured together via cast-in-place concrete closures as described herein. This feature, along with the monolithic arch beams, produce a stable structure that provides stability during backfilling and reduces unwanted movement of the components following installation. The disclosed arch bridge system also provides the flexibility to construct the system entirely of precast components (with the exception of the cast-in-place concrete closures) or from a combination of precast and cast-in-place components. For example, a cast-in-place (conventional) foundation may be used with precast side walls, arch beams, and/or decking panel assemblies.

Having thus described the invention of the present application in detail and by reference to embodiments thereof, it will be apparent that modifications and variations are possible without departing from the scope of the invention defined in the appended claims.

What is claimed is:

1. An arch bridge system comprising:

a first side wall and a second side wall, the first and second side walls extending along a width of the system and being spaced apart with respect to each other to define a length of the system therebetween;

a foundation positioned beneath the first and second side walls; and a plurality of arch beams spanning the length of the system and spaced along the width of the system, wherein the first and second side walls each comprise a plurality of side wall sections supported by the foundation and aligned along the width of the system;

wherein adjacent side wall sections form a column therebetween, the column defining an interior void extending along a height of the column;

wherein each of the plurality of arch beams comprise a first end and a second end opposite the first end, the first end being supported at the first side wall at an upper portion of one of the columns and the second end being supported at the second side wall at an upper portion of another one of the columns; and wherein each interior void comprises reinforced concrete forming cast-in-place columns defining rigid, fixed, monolithic connections between the foundation, the first and second side walls, and the plurality of arch beams.

2. The arch bridge system of claim 1, further comprising a plurality of decking panel assemblies, each decking panel assembly comprising a plurality of decking panels, each decking panel having a first decking panel end and a second decking panel end, wherein the first decking panel end is supported by one of the plurality of arch beams and the second decking panel end is supported by an adjacent one of the plurality of arch beams.

3. The arch bridge system of claim 2, wherein each decking panel assembly further comprises at least one cable connecting the plurality of decking panels and extending along the length of the system.

4. The arch bridge system of claim 2, wherein the first and second side walls terminate at a first end wall of the system and a second end wall of the system, and wherein one of the plurality of arch beams most proximate to the first end wall and one of the plurality of arch beams most proximate to the second end wall each support a headwall.

5. The arch bridge system of claim 2, wherein each side wall section comprises a wall panel and an abutment panel, the wall panel being supported by the foundation and the abutment panel being supported by the wall panel, wherein each abutment panel comprises a top edge, a bottom edge opposite the top edge, a first support surface, and a pair of second support surfaces, and wherein:

the top edge, the first support surface, and the second support surfaces face away from the foundation;

the first support surface is closer to the foundation than the top edge;

the second support surfaces are closer to the foundation than the first support surface; and the first end of each of the plurality of arch beams is supported by ones of the pair of second support surfaces of adjacent abutment panels of the first side wall and the second end of each of the plurality of arch beams is supported by ones of the pair of second support surfaces of adjacent abutment panels of the second side wall.

6. The arch bridge system of claim 5, wherein each of the plurality of decking panel assemblies comprises a first decking panel and a last decking panel, wherein:

the first decking panel is further supported by the first support surface of one of the abutment panels of the first side wall; and the last decking panel is further supported by the first support surface of one of the abutment panels of the second side wall.

7. The arch bridge system of claim 6, wherein the reinforced concrete permanently confines each of the plurality of decking panel assemblies.

8. The arch bridge system of claim 1, wherein the foundation comprises: (i) strip footings or spread footings; (ii) a slab foundation or mat foundation; or (iii) a deep foundation system comprising driven piles or drilled shafts.

9. The arch bridge system of claim 1, wherein each side wall section comprises a wall panel and an abutment panel, the wall panel being supported by the foundation and the abutment panel being supported by the wall panel, wherein each abutment panel comprises a top edge, a bottom edge opposite the top edge, a first support surface, and a pair of second support surfaces, and wherein:

the top edge, the first support surface, and the second support surfaces face away from the foundation;

the first support surface is closer to the foundation than the top edge; and the second support surfaces are closer to the foundation than the first support surface.

10. The arch bridge system of claim 9, wherein the wall panel and the abutment panel each comprise an interior side and an exterior side, the interior side being substantially planar and the exterior side defining a respective central cavity.

11. A method of producing an arch bridge system, comprising:

installing a foundation;

installing a first side wall and a second side wall, the first and second side walls extending a width of the system and being spaced apart with respect to each other to define a length of the system therebetween, the first and second side walls each comprising a plurality of side wall sections supported by the foundation and aligned along the width of the system, wherein adjacent side wall sections form a column therebetween, the column comprising an interior void extending along a height of the column;

installing a plurality of arch beams that span the length of the system and are spaced along the width of the system, the plurality of arch beams each comprising a first end and a second end opposite the first end, the first end being supported at the first side wall at an upper portion of one of the columns and the second end being supported at the second side wall at an upper portion of another one of the columns; and filling each interior void with concrete to form cast-in-place columns defining rigid, fixed, monolithic connections between the foundation, the first and second side walls, and the plurality of arch beams.

12. The method of claim 11, further comprising installing a plurality of decking panel assemblies, each decking panel assembly comprising a plurality of decking panels, each decking panel having a first decking panel end and a second decking panel end, wherein the first decking panel end is supported by one of the plurality of arch beams and the second decking panel end is supported by an adjacent one of the plurality of arch beams.

13. The method of claim 12, wherein the plurality of decking panels of each decking panel assembly are connected with at least one cable extending along the length of the system.

14. The method of claim 12, wherein the first and second side walls terminate at a first end wall of the system and a second end wall of the system, the method further comprising installing a headwall at each of (i) one of the plurality of arch beams most proximate to the first end wall and (ii) one of the plurality of arch beams most proximate to the second end wall.

15. The method of claim 12, wherein installing the first and second side walls sections comprises installing, for each side wall section, a wall panel that is supported by the foundation and an abutment panel supported by the wall panel, wherein each abutment panel comprises a top edge, a bottom edge opposite the top edge, a first support surface, and a pair of second support surfaces, and wherein:

the top edge, the first support surface, and the second support surfaces face away from the foundation;

the first support surface is closer to the foundation than the top edge;

the second support surfaces are closer to the foundation than the first support surface; and the first end of each of the plurality of arch beams is supported by ones of the pair of second support surfaces of adjacent abutment panels of the first side wall and the second end of each of the plurality of arch beams is supported by ones of the pair of second support surfaces of adjacent abutment panels of the second side wall.

16. The method of claim 15, wherein each of the plurality of decking panel assemblies comprises a first decking panel and a last decking panel, wherein:

the first decking panel is further supported by the first support surface of one of the abutment panels of the first side wall; and the last decking panel is further supported by the first support surface of one of the abutment panels of the second side wall.

17. The method of claim 16, further comprising permanently confining each of the plurality of decking panel assemblies with the concrete of the cast-in-place columns.

18. The method of claim 11, wherein the foundation comprises: (i) strip footings or spread footings; (ii) a slab foundation or mat foundation; or (iii) a deep foundation system comprising driven piles or drilled shafts.

19. The method of claim 11, wherein installing the first and second side walls sections comprises installing, for each side wall section, a wall panel that is supported by the foundation and an abutment panel supported by the wall panel, wherein each abutment panel comprises a top edge, a bottom edge opposite the top edge, a first support surface, and a pair of second support surfaces, and wherein:

the top edge, the first support surface, and the second support surfaces face away from the foundation;

the first support surface is closer to the foundation than the top edge; and the second support surfaces are closer to the foundation than the first support surface.

20. The arch bridge system of claim 19, wherein the wall panel and the abutment panel each comprise an interior side and an exterior side, the interior side being substantially planar and the exterior side defining a central cavity.

* * * * *